US008807719B2

(12) United States Patent
Hoisington et al.

(10) Patent No.: US 8,807,719 B2
(45) **Date of Patent: *Aug. 19, 2014**

(54) FLUID RECIRCULATION IN DROPLET EJECTION DEVICES

(71) Applicant: FUJIFILM Corporation, Tokyo (JP)

(72) Inventors: Paul A. Hoisington, Hanover, NH (US); Christoph Menzel, New London, NH (US); Mats G. Ottosson, Saltsjo-Boo (SE); Kevin von Essen, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/057,180

(22) Filed: Oct. 18, 2013

(65) Prior Publication Data

US 2014/0043404 A1 Feb. 13, 2014

Related U.S. Application Data

(63) Continuation of application No. 12/980,295, filed on Dec. 28, 2010, now Pat. No. 8,657,420.

(51) Int. Cl.
*B41J 2/175* (2006.01)

(52) U.S. Cl.
USPC ..... 347/85; 347/65; 347/87; 347/84; 347/86

(58) Field of Classification Search
USPC ..... 347/84–87, 89, 90, 65
See application file for complete search history.

(56) References Cited

U.S. PATENT DOCUMENTS

| | | | | |
|---|---|---|---|---|
| 4,835,554 | A | 5/1989 | Hoisington et al. | |
| 5,771,052 | A | 6/1998 | Hine et al. | |
| 6,007,193 | A | 12/1999 | Kashimura et al. | |
| 6,074,035 | A | 6/2000 | Irizawa et al. | |
| 6,120,139 | A * | 9/2000 | Childers et al. | 347/92 |

(Continued)

FOREIGN PATENT DOCUMENTS

| | | | |
|---|---|---|---|
| JP | 2002-210965 | 7/2002 | |
| JP | 2006-269593 | 9/2007 | |
| WO | 2009/143362 | 11/2009 | |
| WO | WO 2009/142889 | * 11/2009 | B41J 2/18 |

OTHER PUBLICATIONS

International Search Report and Written Opinion dated Jul. 23, 2009 issued in international application No. PCT/US2009/044868, 10 pgs.

(Continued)

*Primary Examiner* — Henok Legesse
(74) *Attorney, Agent, or Firm* — Fish & Richardson P.C.

(57) ABSTRACT

A fluid ejection apparatus includes a fluid distribution layer between a fluid manifold and a substrate. The fluid distribution layer includes fluid supply channels and fluid return channels. Each fluid supply channel receives fluid from the fluid supply chamber and circulates a fraction of the received fluid back to the fluid return chamber through a return-side bypass. The substrate include a plurality of flow paths, each flow path includes a nozzle for ejecting fluid droplets. Each flow path receives fluid from a respective fluid supply channel, and channel un-ejected fluid into a respective fluid return channel. Each fluid return channel can collect the un-ejected fluid from one or more flow paths and a supply-side bypass, and return the collected fluid back to the fluid supply chamber.

21 Claims, 8 Drawing Sheets

(56) References Cited

U.S. PATENT DOCUMENTS

| | | | | |
|---|---|---|---|---|
| 6,886,924 | B2 | 5/2005 | Hasenbein et al. | |
| 7,128,406 | B2 | 10/2006 | Dixon et al. | |
| 7,309,119 | B2 | 12/2007 | Kojima | |
| 8,287,098 | B2 * | 10/2012 | Mukai et al. | 347/56 |
| 2002/0051039 | A1 | 5/2002 | Moynihan et al. | |
| 2003/0085307 | A1 * | 5/2003 | Okuda et al. | 239/548 |
| 2003/0098901 | A1 * | 5/2003 | Okuda | 347/68 |
| 2007/0046736 | A1 | 3/2007 | Katayama et al. | |
| 2008/0030553 | A1 | 2/2008 | Takahashi | |
| 2008/0055378 | A1 | 3/2008 | Drury et al. | |
| 2010/0289857 | A1 | 11/2010 | Bennett | |
| 2011/0148988 | A1 * | 6/2011 | Hoisington et al. | 347/54 |

OTHER PUBLICATIONS

International Preliminary Report on Patentability dated Dec. 2, 2010 issued in international application No. PCT/US2009/044868, 9 pgs.

Laurell et al., "Design and development of a silicon microfabricated flow-through dispenser for on-line picolitre sample handling," J.Micromech.MICROENG. 9:369-76 (1999), 8 pgs.

International Search Report and Written Opinion dated Apr. 10, 2012 issued in international application No. PCT/US2011/063656, 11 pgs.

* cited by examiner

FLUID RECIRCULATION IN DROPLET EJECTION DEVICES

CLAIM OF PRIORITY

This application is a continuation of U.S. patent application Ser. No. 12/980,295, filed Dec. 28, 2010, the entire contents of which are hereby incorporated by reference.

TECHNICAL FIELD

This specification generally relates to fluid droplet ejection.

BACKGROUND

In some fluid ejection devices, a flow path including a fluid pumping chamber and a nozzle can be formed in a substrate. Fluid droplets can be ejected from the nozzle onto a medium, such as in a printing operation. The fluid pumping chamber can be actuated by a transducer, such as a thermal or piezoelectric actuator, and when actuated, the fluid pumping chamber can cause ejection of a fluid droplet through the nozzle. The medium can be moved relative to the fluid ejection device, e.g., in a media scan direction. The ejection of the fluid droplet can be timed with the movement of the medium to place a fluid droplet at a desired location on the medium. A fluid ejection device typically includes multiple nozzles, such as a line or an array of nozzles with a corresponding array of fluid paths and associated actuators, and droplet ejection from each nozzle can be independently controlled by one or more controllers. It is usually desirable to eject fluid droplets of uniform sizes and speed, and in the same direction, to provide uniform deposition of fluid droplets on a medium.

SUMMARY

This specification describes technologies related to systems, apparatus, and methods for fluid droplet ejection.

In one aspect, the systems, apparatus, and methods disclosed herein feature a printhead module having a fluid distribution layer between a fluid manifold and a substrate. The fluid manifold includes a fluid supply chamber and a fluid return chamber. The substrate has at least a flow path including a nozzle inlet, a nozzle, and a nozzle outlet. The fluid distribution layer includes at least one fluid supply channel. The fluid supply channel includes a supply inlet that is in fluidic communication with the fluid supply chamber, and a return-side bypass that is in fluidic communication with the fluid return chamber. The fluid supply channel is also in fluidic communication with the nozzle inlet of at least one flow path in the substrate. The fluid distribution layer can also include at least one fluid return channel. The fluid return channel includes a supply-side bypass that is in fluidic communication with the fluid supply chamber, and a return outlet that is in fluidic communication with the fluid return chamber. The fluid return channel is also in fluidic communication with the nozzle outlet of at least one flow path in the substrate. The at least one nozzle outlet in the substrate is in fluid communication with the at least one nozzle inlet mentioned above.

Within the printhead module, a first circulation path can be formed through the fluid distribution layer in a sequence starting from the fluid supply chamber to the supply inlet fluidically connecting the fluid supply chamber and the fluid supply channel, through the supply inlet and into the fluid supply channel, across the length of the fluid supply channel to the return-side bypass fluidically connecting the fluid supply channel to the fluid return chamber, through the return-side bypass, and ending in the fluid return chamber.

Within the printhead module, a second circulation path can be formed through the substrate in a sequence starting from the fluid supply channel, through the nozzle inlet in the substrate, across the length of the flow path in the substrate, through the nozzle outlet in the substrate, and ending in the fluid return channel.

In various implementations where the return channel includes a return outlet and a supply-side bypass, a third circulation can be formed in the fluid distribution layer in a sequence starting from the fluid supply chamber to a supply-side bypass fluidically connecting the fluid supply chamber and the fluid return channel, through the supply-side bypass and into the fluid return channel, across the length of the fluid return channel to a return outlet fluidically connecting the fluid return channel and the fluid return chamber, through the return outlet, and ending in the fluid return chamber.

In various implementations, a fourth circulation can be formed in the fluid manifold, from the fluid return chamber to the fluid supply chamber.

In one aspect, the fluid distribution layer can include a plurality of fluid supply channels and a plurality of fluid return channels, and the substrate can include a plurality of flow paths. The fluid supply channels and the fluid return channels can be parallel to one another, and alternately positioned in the fluid distribution layer. The fluid distribution layer can be a planar layer that is parallel to a planar nozzle layer in the substrate. Each fluid supply channel can be configured to receive fluid from the fluid supply chamber through a respective supply inlet fluidically connecting the fluid supply channel to the fluid supply chamber, and to channel away a portion of the received fluid to the fluid return chamber through a respective return-side bypass fluidically connecting the fluid supply channel and the fluid return chamber. Each fluid supply channel is in fluidic communication with one or more flow paths through the respective nozzle inlets of the flow paths. Each flow path is configured to receive at least some of the fluid in a respective fluid supply channel through the respective nozzle inlet of the flow path and to channel the fluid to the respective nozzle outlet of the flow path. Each fluid return channel is in fluidic communication with one or more flow paths via the respective nozzle outlets of the flow paths, and configured to receive un-ejected fluid from the flow paths and return the un-ejected fluid to the fluid return chamber through a respective return outlet fluidically connecting the fluid return channel and the fluid return chamber. Each fluid return channel can also be configured to receive fluid from the fluid supply chamber through a respective supply-side bypass fluidically connecting the fluid return channel to the fluid supply chamber, and to return the received fluid to the fluid return chamber through the respective return outlet.

In various implementations, one or more of the following features may also be included. For example, each of one or more fluid supply channels in the fluid distribution layer can be an elongated channel having a supply inlet at a first distal end proximate the fluid supply chamber, and having a return-side bypass at a second distal end proximate the fluid return chamber. The flow resistance of the return-side bypass can be several times the flow resistance of the supply inlet. The higher flow resistance of the return-side bypass can lead to a lower flow capacity of the return-side bypass as compared to the flow capacity of the supply inlet. For example, the supply inlet can be a first aperture in an interface between the fluid supply channel and the fluid supply chamber, and the return-side bypass can be a second aperture in an interface between the fluid supply channel and the fluid return chamber. The second aperture can be smaller in size than the first aperture (e.g., the return-side bypass can be 1/50 of the size of the supply inlet). Other means of increasing the flow resistance and restricting the flow capacity of the return-side bypass are possible.

Similarly, each of one or more fluid return channels in the fluid distribution layer can be an elongated channel having a supply-side bypass at a first distal end proximate the fluid supply chamber, and having a return outlet at a second distal end proximate the fluid return chamber. The flow resistance of the supply-side bypass can be several times the flow resistance of the return outlet. The higher flow resistance of the supply-side bypass can lead to a lower flow capacity of the supply-side bypass as compared to a flow capacity of the return outlet. For example, the supply-side bypass can be a first aperture in an interface between the fluid return channel and the fluid supply chamber. The return outlet can be a second aperture in an interface between the fluid return channel and the fluid return chamber. The first aperture can be smaller in size than the second aperture (e.g., the supply-side bypass can be 1/50 of the size of the return outlet). Other means of increasing the flow resistance and restricting the flow capacity of the supply-side bypass are possible.

Each fluid supply channel can be in fluidic communication with one or more flow paths in the substrate via the respective nozzle inlets of the flow paths, and provide fluid to the flow paths in the substrate. Each fluid return channel can be in fluidic communication with one or more flow paths in the substrate via the respective nozzle outlets of the flow paths, and collect un-ejected fluid from the flow paths in the substrate. A fluid supply channel and a fluid return channel that are adjacent to each other in the fluid distribution layer can be in fluidic communication with each other through at least one flow path in the substrate. For example, while a first nozzle inlet is in fluid communication with a fluid supply channel, a first nozzle outlet associated with the same nozzle as the first nozzle inlet is in fluid communication with a fluid return channel that is adjacent to the fluid supply channel.

In some implementations, a filter can be placed in the circulation paths (e.g., inside the fluid supply chamber). The filter can be configured to remove contaminants from the circulated fluid.

In some implementations, a temperature sensor and/or flow control device can be included in the circulation paths. The temperature sensor can detect a temperature at various locations in the substrate. The flow control device can be used to adjust a pressure difference between the fluid supply chamber and the fluid return chamber in response to the readings of the temperature sensor. The pressure difference can then adjust the flow rate in the various circulation paths.

In another aspect, the systems, apparatus, and methods disclosed herein feature flowing a first flow of fluid in sequence of: flowing the fluid from a fluid supply chamber to a supply inlet fluidically connecting the fluid supply chamber and a fluid supply channel, through the fluid supply inlet and into the fluid supply channel, across the length of the fluid supply channel to a return-side bypass fluidically connecting the fluid supply channel and a fluid return chamber, and through the return-side bypass into the fluid return chamber. Simultaneously with flowing the first flow of fluid, flowing a second flow of fluid across the fluid supply channel, to a nozzle inlet in a substrate, through the nozzle inlet into the substrate, through a flow path in the substrate to a nozzle outlet in the substrate, through the nozzle outlet and into a fluid return channel. The first flow and the second flow are in fluidic communication within the fluid supply channel.

Optionally, simultaneously with flowing the first flow of fluid and the second flow of fluid, a third flow of fluid can be flown from the fluid supply chamber to a supply-side bypass fluidically connecting the fluid supply chamber and the fluid return channel, through the supply-side bypass and into the fluid return channel, across the length of the fluid return channel to a return outlet fluidically connecting the fluid return channel and the fluid return chamber, and through the return outlet and into the fluid return chamber.

A pressure drop can be created between the fluid supply chamber and the fluid return chamber, which causes the first flow, the second flow, and optionally, the third flow. A fourth flow can be flown from the fluid return chamber to the fluid supply chamber in the fluid manifold. A filter for removing air and contaminants can be placed in the circulation paths (e.g., in the fluid supply chamber). The pressure difference between the fluid supply chamber and the fluid return chamber can be adjusted according to a temperature of fluid in one or more of the first flow, the second flow, and the third flow.

In another aspect, the nozzles in the substrate are distributed in parallel nozzle columns along a first direction that is at a first angle relative to the media scan direction associated with the printhead module. The fluid supply channels and the fluid return channels are parallel channels that are alternately positioned in the fluid distribution layer. The fluid supply channels and the fluid return channels are along a second direction that is at a second, different angle relative to the media scan direction. Each fluid supply channel can be in fluidic communication with nozzles from multiple consecutive nozzle columns, via respective nozzle inlets of the nozzles. Similarly, each fluid return channel can be in fluidic communication with multiple nozzles in multiple consecutive nozzle columns, via respective nozzle outlets of the nozzles. Each fluid supply channel is in fluid communication with a fluid return channel adjacent to the fluid supply channel on either side of the fluid supply channel, via one or more flow paths in the substrate.

In another aspect, the nozzle columns in the substrate form a parallelogram-shaped nozzle array. One or more first fluid supply channels in proximity to a first acute corner of the nozzle array can be shorter and in fluidic communication with fewer flow paths in the substrate than other fluid supply channels that are located in proximity to the main portion (e.g., portions away from the two acute corners) of the nozzle array. In some implementations, two or more of the shorter fluid supply channels can be joined to a first joining channel in the fluid distribution layer, such that the two or more shorter fluid supply channels are in fluidic communication with approximately the same number of flow paths as those other fluid supply channels located in proximity to the main portion of the nozzle array. The first joining channel can include a supply inlet that fluidically connects the first joining channel to the fluid supply chamber, and hence fluidically connects the shorter, first fluid supply channels to the fluid supply chamber.

In addition, one or more first fluid return channels located in proximity to the first acute corner of the nozzle array can be shorter than other fluid return channels located in proximity to the main portion of the nozzle array. The one or more first fluid return channels can be fluidically connected to the first joining channel via one or more first bypass gaps, respectively. The one or more first bypass gaps can be configured to function as the supply side-bypasses for the one or more first fluid return channels, which fluidically connect the one or more first fluid return channels to the fluid supply chamber.

The flow resistance of the bypass gaps can be several times the flow resistance of the supply inlet in the first joining channel, such as 10 times the flow resistance of the flow resistance of the fluid joining channel. The higher flow resistance of the bypass gaps can lead to a lower flow capacity of the bypass gaps as compared to the flow capacity of the first fluid joining channel, such as 1/50 of the flow capacity of the flow capacity of the first fluid joining channel.

Similarly, one or more second fluid return channels located in proximity to a second acute corner of the nozzle array can be shorter and in fluidic communication with fewer flow paths in the substrate than other fluid return channels located in proximity to the main portion (e.g., portions away from the two acute corners) of the nozzle array. In some implementations, two or more of the shorter fluid return channels can be joined by a second joining channel in the fluid distribution layer, such that the two or more shorter fluid return channels are in fluidic communication with approximately the same number of flow paths as those other fluid return channels in proximity to the main portion of the nozzle array. The second joining channel can include a return outlet that fluidically connects the second joining channel to the fluid return chamber, and hence fluidically connects the shorter, second fluid return channels to the fluid return chamber.

In addition, one or more second fluid supply channels located in proximity to the second acute corner of the nozzle array can be shorter than other fluid supply channels in proximity to the main portion of the nozzle array. The one or more second fluid supply channels can be fluidically connected to the second joining channel via one or more second bypass gaps, respectively. The one or more second bypass gaps can be configured to function as the return-side bypasses for the one or more first fluid supply channels, which fluidically connect the one or more shorter, first fluid supply channels to the fluid return chamber.

The flow resistance of the bypass gap is several times the flow resistance of the return outlet, such as 10 times the flow resistance of the return outlet in the second joining channel. The higher flow resistance of the bypass gap can lead to a lower flow capacity of the bypass gap as compared to the flow capacity of the return outlet in the second joining channel, such as 1/50 of the flow capacity of return outlet of the second fluid joining channel.

These general and specific aspects may be implemented, separately or in any combination, using a system, an apparatus, or any combination of systems, apparatus, and methods.

Particular implementations of the subject matter described in this specification can be implemented so as to realize one or more of the following advantages.

First, circulating fluid through the substrate can remove air bubbles, aerated ink, debris, and other contaminants from the substrate. When some fluid is pushed through the substrate without being ejected out of the nozzles, debris and contaminants can be carried from their original sites in the flow paths along with the flow, and subsequently removed by various means, such as by using a degasser or filter.

In addition, circulating fluid from a supply inlet to a return-side bypass in a fluid supply channel can cause a pressure drop between the nozzle inlet in fluidic communication with the fluid supply channel and the nozzle outlet in fluidic communication with the fluid return channel. The pressure drop created by the flow between the supply inlet and the return-side bypass can cause fluid to flow along the flow path in the substrate without using a pump to directly draw fluid in and/or out of the substrate. Therefore, the substrate can be isolated from pressure disturbances typically caused by a pump, which can cause cross-talk and unevenness in drop sizes.

In addition, by maintaining a constant fluid flow through the flow path within the substrate without ejecting droplets from the nozzle, the nozzle surface can be kept from drying out during prolonged inactivity. Keeping the nozzle surface wetted during idle time can prevent ink debris from building up on the nozzle surface and affecting printing quality.

In addition, flowing temperature-controlled fluid both over and through the substrate can regulate the temperature of both the substrate and of the fluid flowing through the substrate. When fluid ejected by the substrate is kept at a constant temperature during a printing operation, the size of each fluid droplet that is expelled can be accurately controlled. Such control can result in uniform printing over time and can eliminate wasted warm up or practice printing run.

In addition, the flow rates through the fluid supply and return channels can be accurately controlled by the respective sizes of the supply inlet and the return-side bypass, and similarly, by the respective sizes of the supply-side bypass and the return outlet. The sizes and dimensions of the supply inlet, the return outlet, the supply-side bypass, and the return-side bypass are relatively easy to control during manufacturing process, and therefore, the temperature control quality of the fluid distribution layer can be consistently maintained for multiple printhead modules that are used together (e.g., in a multi-module print bar).

In addition, in some implementations, the direction of the fluid supply and return channels are parallel to one another and are in a direction that is at an angle relative to the direction of the nozzle columns. By offsetting the parallel fluid supply and return channels at an angle relative to the direction of the nozzle columns, the supply and return channels can be made wider than if the supply and return channels were aligned and parallel to the direction of the nozzle columns. By having wider supply and/or return channels, a larger flow and higher flow rate can be accommodated in the fluid supply and/or return channels, and a larger range of temperature regulation becomes possible. In addition, by having a higher flow rate and a larger flow volume, the flow's ability to push the circulated liquid through the filter for air bubble and contaminant removal can also be improved.

In addition, in implementations where the direction of the fluid supply and return channels are offset at an angle relative to the direction of the nozzle columns, the shorter fluid supply channels (and/or return channels) located in proximity to a sharper corner of the nozzle array can be joined by a joining channel. The joined fluid supply channels (or return channels) can be made to fluidly communicate with approximately the same number of flow paths in the substrate as other supply channels (or return channels) located near the main portion of the nozzle array. Therefore, roughly the same pressure drop and flow rate can be created in the shorter supply or return channels as the longer channels near the main portion of the nozzle array. Thus, the temperature control across the entire nozzle array can be kept roughly uniform, leading to better uniformity in drop size.

The details of one or more implementations of the subject matter described in this specification are set forth in the accompanying drawings and the description below. Other features, aspects, and advantages of the subject matter will become apparent from the description, the drawings, and the claims.

Figure 1:
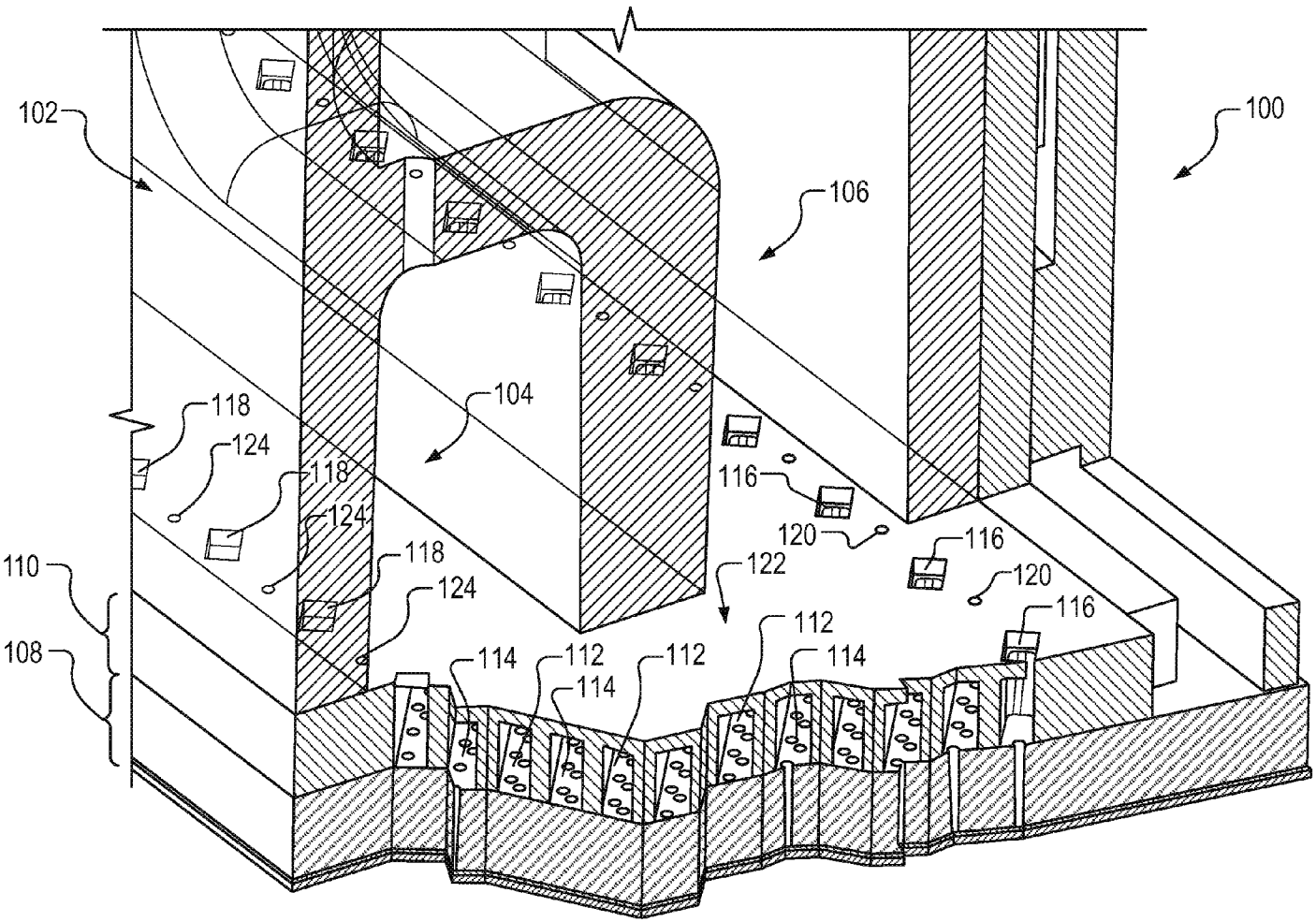
FIG. 1 is a cross-sectional perspective view of an example printhead module.

List of reference numerals:

| | | | |
|---|---|---|---|
| 100 | Printhead module | 102 | Fluid manifold |
| 104 | Fluid supply chamber | 106 | Fluid return chamber |
| 108 | Substrate | 110 | Fluid distribution layer |
| 112 | Fluid supply channel | 114 | Fluid return channel |
| 116 | Return outlet | 118 | Supply inlet |
| 120 | Return-side bypass | 122 | Top surface of fluid distribution layer |
| 124 | Supply-side bypass | 200 | Nozzle array |
| 202 | Nozzle column | 204 | Nozzle |
| 206 | Pumping chamber | 208 | Nozzle inlet |
| 210 | Nozzle outlet | 212 | Joining channel |
| 214 | Bypass gap | 216 | A line of nozzles |
| 218 | A line of nozzle inlets | 220 | A line of nozzle outlets |
| 222 | Another line of nozzles | 224 | Another line of nozzles |
| 302 | Bottom surface of fluid distribution layer | | |
| 402 | Feed layer | 404 | Opening to descender |
| 406 | Opening to ascender | 408 | Actuation layer |
| 502 | Descender | 504 | Ascender |
| 506 | Actuator | 602 | Pumping chamber layer |
| 604 | Inlet feed | 606 | Outlet feed |
| 608 | Line of nozzle inlets | 610 | Line of nozzle outlets |
| 612 | Pumping chamber cavity | 614 | Nozzle opening |

Many of the layers and features are exaggerated to better show the features, process steps, and results. Like reference numbers and designations in the various drawings indicate like elements.

DETAILED DESCRIPTION

Fluid droplet ejection can be implemented with a printhead, such as the example printhead module 100 shown in FIG. 1. The example printhead module 100 includes a fluid manifold 102, a substrate 108, and a fluid distribution layer 110. The fluid manifold 102 includes a fluid supply chamber 104 and a fluid return chamber 106. The fluid manifold 102 can be a plastic body with recesses on a bottom surface, e.g., formed by molding or machining, such that when the bottom surface of the fluid manifold 102 is secured to the top of the fluid distribution layer 110, e.g., by adhesive, the volume above the fluid distribution layer 110 in the recesses defines the fluid supply chamber 104 and a fluid return chamber 106.

The substrate 108 can include a printhead die that has one or more micro-fabricated fluid flow paths, each of the fluid flow paths can include one or more nozzles for ejecting fluid droplets. Fluid can be ejected onto a medium through the one or more nozzles, and the printhead module 100 and the medium can undergo relative motion during fluid droplet ejection.

The fluid distribution layer 110 is located between the fluid manifold 102 and the substrate 108. The fluid distribution layer 110 can receive fluid from the fluid supply chamber 104, and distribute the fluid to the one or more flow paths in the substrate 108. The fluid distribution can be performed by one or more fluid supply channels 112 in the fluid distribution layer 110 that are in fluidic communication with the one or more flow paths via respective nozzle inlets associated with the flow paths.

The fluid can be continuously circulated through the flow paths in the substrate 108 regardless of whether droplets are being ejected out of the nozzles in the substrate 108. Fluid that is not ejected out of the nozzles can be re-circulated in one or more recirculation passages. The re-circulated fluid can be directed to the fluid return chamber 106 through the one or more recirculation passages. For example, the re-circulated fluid can be collected from the one or more flow paths in the substrate 108, via one or more fluid return channels 114 in the fluid distribution layer 110. The fluid return channels 114 can be in fluidic communication with the one or more flow paths via respective nozzle outlets associated with the flow paths.

In some implementations, the re-circulated fluid can be discarded, in the event that the re-circulated fluid includes contaminants (such as air bubbles, dried ink, debris, etc.) that are not easily removable. In some implementations, the re-circulated fluid can circulate back to the fluid return chamber 106 from the fluid return channels 114 through the return outlets 116 in the top surface of the fluid distribution layer 110. The fluid in the fluid return chamber 106 can be circulated back to the fluid supply chamber 104 and reused in a subsequent fluid ejection operation. For example, the re-circulated fluid in the fluid supply chamber 104 can flow into the fluid supply channels 112 through the supply inlets 118 on the top surface of the fluid distribution layer 110, along with any fluid newly added to the fluid supply chamber 104.

In some implementations, one or more filters can be placed at various locations in the circulation paths from the return outlets 116 in the fluid return chamber 106 to the supply inlets 118 in the fluid supply chamber 104, to remove contaminants (such as air bubbles, aerated fluid, dried ink, debris, etc.). In some implementations, a single filter can be placed in the fluid supply chamber 104 (and not in the fluid return chamber 106) to filter the fluid before the fluid enters the fluid distribution layer 110 through the supply inlets 118. Using a single filter can help to reduce the complexity and cost of the printhead module 100. In addition, by avoiding the use of a filter in the fluid return chamber 106, air bubbles can be more easily removed or released from the fluid return chamber 106 rather than being trapped by the filter in the fluid return chamber 106. In some implementations, if a filter is used in the fluid return chamber 106, a release valve (e.g., a hole) can be placed in the fluid return chamber to release the trapped air bubbles from the fluid return chamber 106.

Although not shown in FIG. 1, fluid can be supplied to the fluid return chamber 106 from a fluid reservoir, and fluid can be supplied to the fluid supply chamber 104 from the fluid return chamber 106. A pressure difference can be created between the fluid in the fluid supply chamber 104 and the fluid return chamber 106, for example, by using one or more pumps in the fluid reservoir or by changing the fluid level in the fluid reservoir. The pressure difference can cause the fluid to circulate in the printhead module 100.

In various implementations, the substrate 108 can include multiple layers, such as a semiconductor body bonded with one or more other layers. Various features (e.g., flow paths) can be formed through one or more layers in the substrate 108. In some implementations, the substrate 108 can include the printhead die and an integrated ASIC layer having fluid passages (e.g., ascenders and descenders) formed therethrough, and the fluid passages are connected to the flow paths in the printhead die.

In various implementations, fluid can be circulated through the flow paths in the substrate 108 by one or more pumps. However, pumping fluid through the flow paths in the substrate 108 using pumps can cause disturbances in the fluid flow, and affect printing quality. As described in this specification, a return-side bypass opening 120 can be created in an interface between the fluid supply channel 112 and the fluid return chamber 106 (e.g., in the top surface 122 of the fluid distribution layer 110) at one distal end of a fluid supply channel 112 proximate the fluid return chamber 106. At the other distal end of the fluid supply channel 112 (e.g., the end of the fluid supply channel proximate the fluid supply chamber 104 and opposite to the return-side bypass opening 120), a corresponding supply inlet 118 can be formed in an interface between the fluid supply channel 112 and the fluid supply chamber 104 (e.g., in the top surface 122 of the fluid distribution layer 110). When there is a pressure drop between the fluid supply chamber 104 and the fluid return chamber 106, a pressure drop can be created between the return-side bypass opening 120 and the supply inlet 118, causing fluid to enter the fluid supply channel 112 through the supply inlet 118, flow across the length of the fluid supply channel 112 to the return-side bypass opening 120, and enter the fluid return chamber 106 through the return-side bypass opening 120.

The size of the return-side bypass opening 120 can be smaller than the size of the supply inlet 118, and therefore, the fluid flow at the return-side bypass opening 120 is restricted to a portion of the fluid flow at the supply inlet 118. The portion can be any amount below the total fluid flow at the supply inlet 118. Due to the fluid circulation created between the fluid supply chamber 104 and the fluid return chamber 106 in the fluid supply channel 104, fluid can travel across the length of the fluid supply channel and continuously enter the nozzle inlets of one or more flow paths in the substrate 108 from the fluid supply channel 112. The fluid can flow across the flow paths in the substrate 108, and exit from the nozzle outlets of the flow paths into a flow return channel 114 that is in fluidic communication with the nozzle outlets. The fluid flow in the fluid supply channel 112 and the flow paths in the substrate 108 can continue regardless of whether any fluid is being ejected from the nozzles that are in the flow paths.

In some implementations, in addition to having a return-side bypass opening 120 in a fluid supply channel 112, a supply-side bypass opening 124 can be added to an interface between the fluid return channel 114 and the fluid supply chamber 104 (e.g., the top surface of a fluid return channel 114 in the fluid distribution layer 110). The supply-side bypass opening 124 can be added at the distal end of the fluid return channel 114 proximate the fluid supply chamber 104. A return outlet 116 can be formed at the other distal end of the fluid return channel 114 proximate the fluid return chamber 106. The supply-side bypass opening 124 is in fluidic communication with the fluid supply chamber 104, while the return outlet 116 is in fluidic communication with the fluid return chamber 106.

When there is a pressure drop between the fluid supply chamber 104 and the fluid return chamber 106, fluid can enter the fluid return channel 114 from the fluid supply chamber 104 through the supply-side bypass opening 124, flow across the length of the fluid return channel 114 to the return outlet 116 of the fluid return channel 114, exit the return outlet 116 of the fluid return channel 114, and return to the fluid return chamber 106.

The size of the supply-side bypass opening 124 can be smaller than the size of the return outlet 116 to create a higher flow resistance at the supply-side bypass opening 124 than the flow resistance at the return outlet 116. For example, a flow resistance of the supply-side bypass 124 can be approximately 10 times the flow resistance of the return outlet 116. Therefore, fluid can be drawn into the fluid return channel 114 from the nozzle outlets of one or more flow paths in the substrate 108 that are in fluidic communication with the fluid return channel 114.

In some implementations, both the supply-side bypass openings 124 and the return-side bypass openings 120 are used in the fluid distribution layer 110. When both the supply-side bypass openings 124 and the return-side bypass openings 120 are used in the fluid distribution layer 110, other conditions being equal, more fluid can be circulated through the fluid distribution layer in a given amount time as compared to the case when only one type of bypass openings are used. The additional fluid flow can be desirable in applications where the re-circulated fluid is used to regulate the temperature of the fluid ejection device. In some implementations, only one type of bypass openings (e.g., either the supply-side bypass 124 or the return-side bypass 120) is used. In some implementations, only the return-side bypass openings 120 are used, because the return-side bypass openings 120 have a better ability to facilitate the removal of trapped air bubbles from the fluid ejection device, as compared to the supply-side bypass openings 124. In some implementations, the supply-side bypass openings 124 are apertures that of the same size and shape as the apertures used for the return-side bypass openings 120, and the supply inlets 118 are apertures that are of the same size and shape as the apertures used for the return outlets 116. In some implementations, the supply-side bypass openings 124 can be of different shapes and/or sizes than the return-side bypass openings 120, and the supply inlets 118 can be of different sizes and shapes than the return outlets 116.

Although some parts of the descriptions herein refer to a single supply-side bypass opening and a single return-side bypass opening in the printhead module 100, the printhead module 100 can include multiple fluid supply channels 112 each including a respective return-side bypass opening 120, and multiple fluid return channels 114 each including multiple supply-side bypass openings 124, as shown in FIG. 1.

Although particular shapes and sizes of the bypass openings, supply inlets, and return outlets are shown in FIG. 1, apertures of other shapes and sizes can be used. For example, instead of circular bypass openings, the bypass openings can be apertures that are of rectangular, square, polygonal, elliptical, or other regular or irregular shapes as well. Similarly, instead of rectangular supply inlets and return outlets, the supply inlets and return outlets can be apertures that are of circular, elliptical, polygonal, square, or other regular or irregular shapes, as well.

In addition, fluid is released from the fluid supply channel 112 into the fluid return chamber 106 via a return-side bypass opening 120. The amount of fluid flow or flow rate can be controlled by the flow resistance of the bypass openings 120. In some implementations, the flow resistance of the bypass opening is controlled by the size of the bypass opening 120. In some implementations, other means of controlling the flow resistance of the bypass opening 120 are possible, such as by changing the shape or surface properties of the bypass opening, etc. However, since the size of the bypass opening is relatively easy to control during manufacturing (e.g., through micro-fabrication techniques), it is advantageous to design the size of the bypass opening to control the flow resistance of, and hence the flow rates through the bypass opening and the flow paths in the substrate 108.

As described herein, maintaining continuous fluid flow through the flow paths in the substrate 108 using the bypass openings can help eliminate the need for using a pump to directly pump fluid in and/or out of the flow paths. This can help reduce the disturbances caused by the pump, and thereby improve the printing quality of the printhead module.

In addition, by keeping a continuous fluid flow through the flow paths in the substrate even while the nozzles are inactive (e.g., not ejecting fluid droplets), the nozzles can be kept wet by a meniscus layer. By keeping the nozzle face from drying out during nozzle idle time, debris formed from dried or conglomerated ink pigments can be reduced or eliminated completely. The process for priming the printhead can thus be simplified, and test printing cycles for wetting and cleaning the nozzles can become unnecessary.

In addition, evaporation of the fluid at the nozzle may tend to increase the viscosity of the fluid near the nozzle, which can affect the velocity and volume of ejected fluid droplet. By keeping a continuous flow across the nozzle even when no fluid droplet is being ejected can prevent the viscosity of the fluid at the nozzle from increasing significantly due to evaporation, thereby avoiding the negative impact on the fluid droplet ejection due to the increased viscosity.

In addition, in some implementations, circulating fluid through the printhead and the substrate can also help to maintain the substrate and/or the nozzles at a desired temperature. For a particular fluid, a particular temperature or range of temperatures may be desired for the fluid at the nozzles. For example, a particular fluid may be physically, chemically, or biologically stable within a desired range of temperatures. Various properties of the fluid, e.g., viscosity, density, surface tension, and/or bulk modulus that affect print quality can change with the temperature of the fluid. Controlling the temperature of the fluid can help reduce or manage the negative impact the changed properties of the fluid can have on printing quality. Also, a particular fluid may have desired or optimal ejection characteristics, or other characteristics, within a desired range of temperatures. Controlling the temperature of the fluid at the nozzles can also facilitate uniformity of fluid droplet ejection, since the ejection characteristics of a fluid may vary with temperature.

The temperature of the fluid at the nozzles can be controlled by controlling the temperature of the fluid in the fluid supply channels, the flow rate, and the heat exchange rate between the fluid in the fluid return and supply channels and the fluid flowing across the nozzles. By circulating temperature-controlled fluid in the fluid supply chamber at particularly chosen flow rates in the fluid return chamber, and/or by heating or cooling the fluid in the fluid distribution layer, temperature control of the substrate can be achieved. Uniformity of fluid temperature, as well as fluid droplet ejection characteristics can thereby be improved.

In some implementations, fluid temperature can be monitored with a temperature sensor (not shown) placed in, or attached to, the printhead, the fluid supply chamber, the fluid return chamber, or other suitable locations (shown or not shown). A fluid temperature control device, such as a heater and/or chiller can be placed in the system and configured to control the temperature of fluid. Circuitry can be configured to detect and monitor a temperature reading of the temperature sensor and, in response, control the heater and/or chiller to maintain the fluid at a desired or predetermined temperature. In addition, a flow control device can be used to regulate a pressure difference between the fluid supply chamber and the fluid return chamber, thereby regulating the flow rate through the various circulation paths in the printhead module, a faster flow rate can increase the heat exchange between the substrate and the temperature controlled fluid, and thereby bring the temperature of the substrate closer to a desired level.

Figure 2:
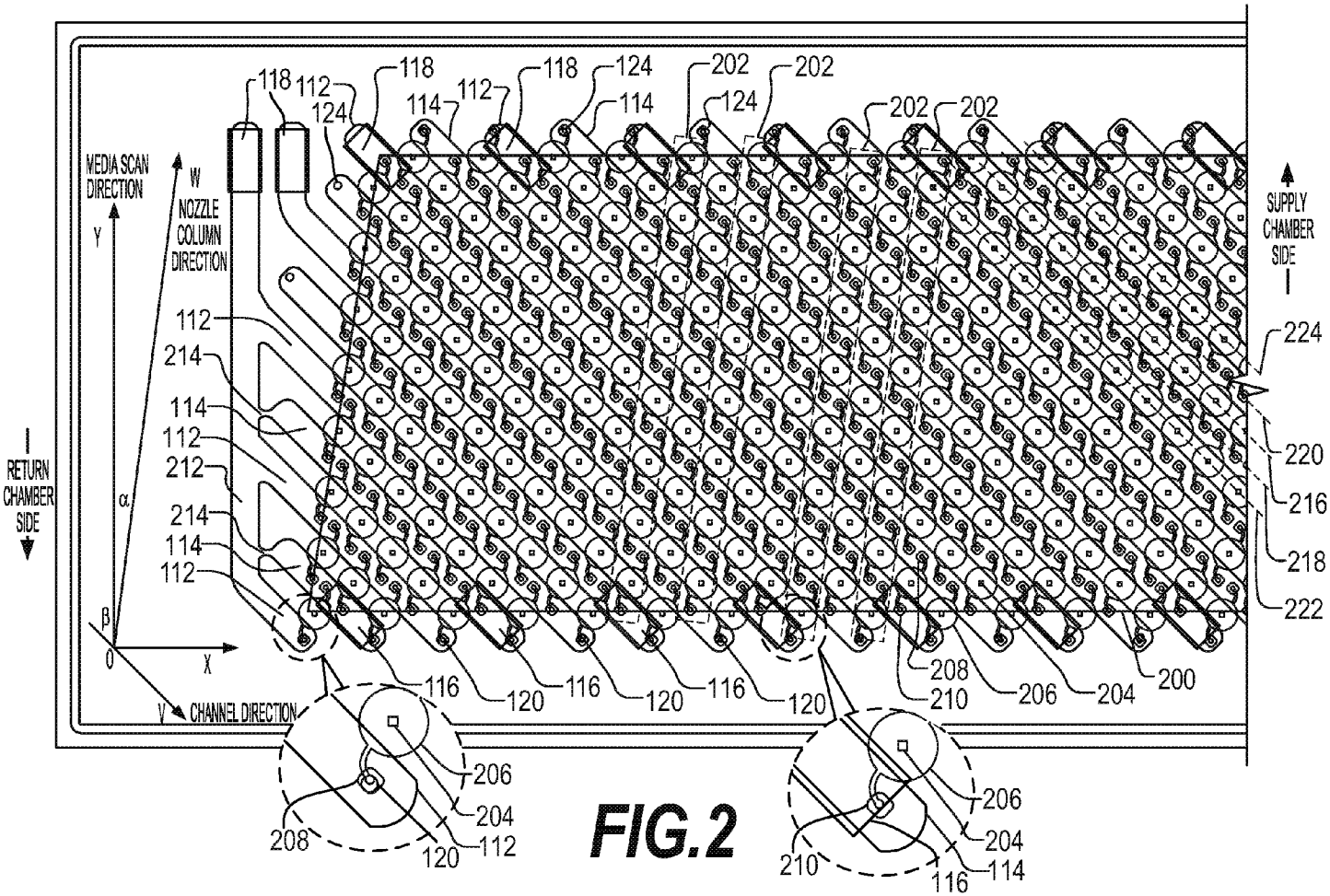
FIG. 2 is a plan view of a fluid distribution layer overlaid on a plan view of a substrate of the example printhead module.

FIG. 2 is a plan view of an example fluid distribution layer (e.g., the fluid distribution layer 110) overlaid on a plan view of an example substrate (e.g., the substrate 108) of an example printhead module (e.g., the printhead module 100 shown in FIG. 1). The fluid distribution layer and the substrate can be substantially planar, and are oriented in parallel to each other. FIG. 2 illustrates the relative positions of the fluid supply channels 112, the fluid return channels 114, the supply inlets 118, the supply-side bypass 124, the return outlets 116, and the return-side bypass 120 in the fluid distribution layer 110, when viewed from the side of the fluid manifold 102. FIG. 2 also illustrates the relative positions of the components of the flow paths in the substrate 108, including nozzles 204, pumping chambers 206, nozzle inlets 208, and nozzle outlets 210, when viewed from the side of the fluid manifold 102. In addition, FIG. 2 also illustrates the relative positions of the components in the fluid distribution layer 110 and the substrate 108, when viewed from the side of the fluid manifold 102.

FIG. 2 shows merely an example layout of the components in the fluid distribution layer 110 and the substrate 108. Other layouts are possible. In addition, in various implementations, fewer or more components can be included in the fluid distribution layer 110 and/or the substrate 108.

First, FIG. 2 shows a nozzle array 200 in the substrate 108. The nozzle array 200 can be formed in a nozzle layer in the substrate 108. The nozzle layer can be below a pumping chamber layer in the substrate 108. The pumping chamber layer includes the pumping chambers 206 and a membrane layer on top of the pumping chamber cavities. The pumping chamber layer can also include nozzle inlets 208 and nozzle outlets 210 that are in fluidic communication with the pumping chamber cavities. The pumping chamber cavities are also in fluidic communication with the nozzles 204 in the nozzle layer.

The pumping chamber layer can be below a feed layer. The feed layer can include vertically oriented descenders that connect the fluid supply channels 112 to corresponding nozzle inlets 208 in the pumping chamber layer, and include vertically oriented ascenders that connect the fluid return channels 114 to corresponding nozzle outlets 210 in the pumping chamber layer. The positions of the descenders can overlap with their corresponding nozzle inlets 208 in the lateral dimensions, and the positions of the ascenders can overlap with their corresponding nozzle outlets 210 in the lateral dimensions, when viewed from the side of the fluid manifold 102.

In various implementations, the nozzle layer, the pumping chamber layer, and the feed layer, are each a planar layer oriented in parallel to each other, to the body of the substrate 108, and to the fluid distribution layer.

Each descender, the nozzle inlet in fluidic communication with the descender, the nozzle inlet in fluidic communication with the descender, the pumping chamber cavity in fluidic communication with the nozzle inlet, the nozzle in fluidic communication with the pumping chamber cavity, the nozzle outlet in fluidic communication with the pumping chamber cavity, and the ascender in fluidic communication with the nozzle outlet, together form a respective flow path in the substrate 108.

As shown in FIG. 2, the nozzle array 200 includes multiple nozzles 204 arranged in multiple parallel nozzle columns 202. In some implementations, the nozzles 204 in each nozzle column 202 can be arranged evenly along a straight line, or approximately along a straight line (e.g., as shown in FIG. 2). In some implementations, the nozzles in each nozzle column 202 can be divided into two or more subgroups (e.g., two or three groups) that are arranged along a straight line or approximately along a straight line.

Suppose, in the plane parallel to the nozzle layer, an x direction and a y direction are perpendicular directions along the width and length of the substrate 108 (e.g., the printhead die), respectively. Suppose that they direction is also the media scan direction during a printing operation. One pair of edges (e.g., the longer edges in this case) of the nozzle array 200 can be in the x direction, perpendicular to the media scan direction, while the other pair of edges (e.g., the shorter edges in this case) of the nozzle array 200 can be in a direction w that is at an angle $\alpha$ with respect to the y direction or the media scanning direction. The nozzle array 200 includes multiple parallel nozzle columns 202 that are oriented in the w direction, and the nozzle array 200 can be in a shape of a parallelogram having two edges in the x direction, and two edges in the w direction.

As used in this specification, the term "nozzle column" refers to a line of nozzles that runs in the same direction as the pair of edges of the nozzle array 200 that are not perpendicular to the media scan direction associated with the printhead module, even though the nozzles in the nozzle array 200 may be aligned along straight lines that run along other directions as well. For example, as shown in FIG. 2, the nozzles 204 in the nozzle array 200 can be aligned along respective straight lines or approximately aligned along respective straight lines that are in a direction v. The direction v can be at an angle ($180°-\beta$) relative to they direction or the media scan direction. In other words, the direction v can be at an angle ($180°-\alpha-\beta$) relative to the direction of the nozzle columns 202.

As shown in FIG. 2, each nozzle 204 in the nozzle layer 200 is located directly below the center of a corresponding pumping chamber 206 in the pumping chamber layer, when viewed from the side of the fluid manifold 102. Within a plane parallel to the pumping chamber layer, each pumping chamber 206 is fluidically connected to a respective nozzle inlet 208 on one side, and fluidically connected to a respective nozzle outlet 210 on an opposite side. As illustrated in FIG. 2, the nozzle inlets 208 associated with the line of nozzles along a first straight line (e.g., the line 216) in the v direction can be arranged along a second straight line (e.g., the line 218) or approximately along a second straight line in the v direction. Similarly, the nozzle outlets 210 associated with the nozzles along the first straight line (e.g., the line 216) in the v direction can be arranged along a third straight line (e.g., the line 220) or approximately along a third straight line in the v direction. The second straight line (e.g., the line 218) and the third straight line (e.g., the line 220) are on two opposite sides of the first straight line (e.g., the 216).

In addition, the nozzle inlets 208 associated with the nozzles along a fourth straight line (e.g., the line 222) that is parallel and adjacent to the first straight line (e.g., the line 216) can be arranged along the second straight line (e.g., the line 218) or approximately along the second straight line in the direction v. Similarly, the nozzle outlets 210 of the nozzles along a fifth straight line (e.g., the line 224) parallel and adjacent to the first straight line (e.g., the line 216) can be arranged along the third straight line (e.g., the line 220) or approximately along the third straight line in the v direction.

Therefore, as shown in FIG. 2, the nozzles 204, the nozzle inlets 208, and the nozzle outlets 210 in the substrate 108 can be arranged along respective straight lines in the direction v, which is at an angle ($180°-\alpha-\beta$) relative to the direction of the nozzle columns 202 (e.g., the w direction). In addition, the lines of nozzle inlets 208 and the lines of nozzle outlets 210 alternate in the substrate 108.

In general, the angle $\alpha$ is a sharp, acute angle and the nozzle columns 202 along the w direction are tightly spaced, in order to create tightly spaced dots (in other words, high resolution) on the printing medium. Consequently, the lines of nozzles formed along the direction v can be more widely spaced as compared to the nozzle columns 202 along the direction w. The wider space available between each pair of adjacent nozzle lines formed along the direction v can be used to accommodate the line of nozzle inlets or the line of nozzle outlets associated with the nozzles in the pair of adjacent lines of nozzles (as shown in FIG. 2).

Although in various implementations, it is possible to form a line of nozzle inlets or a line of nozzle outlets within the space between each pair of nozzle columns 202 formed along the direction w, in situations where there is limited space on the substrate, it is advantageous to arrange the nozzle inlets and nozzle outlets along straight lines within the space between adjacent lines of nozzles along the v direction.

As shown in FIG. 1, the fluid distribution layer 110 is above the substrate 108, and between the fluid manifold 102 and the substrate 108. As shown in FIG. 2, the fluid supply channels 112 and the fluid return channels 114 in the fluid distribution layer 110 are parallel channels that run in the v direction. Each fluid supply channel 112 in the fluid distribution layer 110 is over and aligned with a respective line of nozzle inlets 208 in the substrate 108. Each fluid return channel 114 in the fluid distribution layer 110 is over and aligned with a respective line of nozzle outlets 210 in the substrate 108. Although FIG. 2 shows that the fluid supply channels 112 and the fluid return channels 114 are in the direction v, in various embodiments where the lines of nozzle inlets and nozzle outlets are formed in the direction w, the fluid supply channels 112 and the fluid return channels 114 can also run in the w direction, over and aligned with respective lines of nozzle inlets 208 and/or respective lines of nozzle outlets 210. Each fluid supply channel 112 can supply fluid to a respective line of nozzle inlets 208, while each fluid return channel 114 can collect unused fluid from a respective line of nozzle outlets 210. Each nozzle inlet 208 of the line of nozzle inlets is located along a respective fluid supply channel 112 at a position between the supply inlet and the return-side bypass of the respective fluid supply channel. Similarly, each nozzle outlet 210 of the line of nozzle outlet 210 is located along a respective fluid return channel 114 at a position between the return outlet and the supply-side bypass.

In some implementations, the angle $\alpha$ is a sharp, acute angle, and the nozzle columns along the direction w are tightly spaced. In such implementations, by forming the lines of nozzle inlets and the lines of nozzle outlets in the direction v at an angle to the direction w, more space can be made available to accommodate the width of the fluid supply channels and the fluid return channels in the fluid distribution layer, as well as to accommodate the lines of nozzle inlets and the lines of nozzle outlets in the substrate.

In addition, the wider space between nozzle lines that run in the v direction also allows the fluid supply channels 112 and the fluid return channels 114 to be made wider than they typically could be if the lines of nozzle inlets and the lines of nozzle outlets run along the w direction. It is sometimes advantageous to have wider fluid supply channels and fluid return channels because wider channels allow a greater flow capacity (e.g., faster flow rate or larger flow volume under a given condition) in the fluid supply and return channels, and hence a greater flow capacity (e.g., faster flow rate or larger flow volume under a given condition) in the flow paths in the substrate, and hence larger temperature control range in the substrate and better ability to flush out contaminants in the substrate. In addition, a wider channel also helps to maintain a roughly constant fluid pressure throughout the entire length of the fluid channel, and ensure more uniformity in the velocity and volume of the fluid droplets ejected from the nozzles distributed below different positions along the fluid channel.

As shown in FIG. 2, the fluid supply channels 112 and the fluid return channels 114 alternate in the fluid distribution layer 110. Each fluid supply channel 112 can have a fluid return channel 114 on either side, with the exception of the fluid supply channel over one of the sharper corners of the nozzle array 200, which would only have one adjacent fluid return channel. Similarly, each fluid return channel 114 can have a fluid supply channel 112 on either side, with the exception of the return channel over the other one of the sharper corners of the nozzle array 200, which would only have one adjacent fluid supply channel. Each fluid supply channel 112 is in fluid communication with a respective one line or two lines of nozzle inlets 208, and provides fluid flow into each of the one or two lines of nozzle inlets 208. Each fluid return channel 114 is in fluid communication with a respective one line or two lines of nozzle outlets 210, and collects un-ejected fluid from each of the one or two lines of nozzle outlets 210.

Also as shown in FIG. 2, in some implementations, the direction v of the fluid supply channels 112 and the fluid return channels 114 is at an angle relative to the direction w of the nozzle columns 202, rather than parallel to the direction of the nozzle columns 202. In such implementations, the respective lengths of the fluid supply channels and fluid return channels can be shorter near the two sharper corners (only one is shown in FIG. 2) of the nozzle array 200 than the channels near the other portions (so-called "the main portion") of the nozzle array 200 away from the two sharper corners. Each of the shorter fluid supply channels and return channels are in fluidic communication with fewer flow paths, respectively, than each supply or return channel in the main portion of the nozzle array 200 does.

For example, the first several channels (e.g., the first five channels) near the lower left corner of the nozzle array 200 in FIG. 2 are significantly shorter than the other channels to the right of the first several channels. For example, each of the first five channels are in fluid communication with 1 flow path, 4 flow paths, 8 flow paths, 12 flow paths, and 16 flow paths in the substrate 108, respectively. The channels that are to the right of the first five shorter channels are each in fluid communication with an increasing number of flow paths, until a stable, maximum number of flow paths is reached (e.g., over the main portion of the nozzle array 200, outside of the sharper corners of the nozzle array 200). For example, the channels to the right of the first five channels are each in fluidic communication with 20 flow paths, 24 flow paths, 28 flow paths, 31 flow paths, 32 flow paths, 32 flow paths, 32 flow paths, and so on, respectively.

When nozzles are in operation during fluid droplet ejection, fluid is ejected out of the flow paths under the control of actuators associated with the flow paths. When a shorter fluid supply channel serves significantly fewer nozzles as compared to the other regular-length fluid supply channels, the amount of pressure drop that is needed to achieve a desired amount of fluid circulation for those nozzles served by the shorter fluid supply channel can be significantly different from that is available between the fluid supply chamber and the fluid return chamber. Therefore, in some implementations, it is advantageous to join two or more shorter fluid supply channels near the shaper corner of the nozzle array 200, such that the several shorter fluid supply channels together serve a similar number of flow paths (e.g., more than ½ or ⅔ of the number of flow paths) as the regular-length fluid supply channels (e.g., the channels that are near and serving the main portion of the nozzle array 200).

For example, as shown in FIG. 2, the first three fluid supply channels 112 (out of the first five channels) near the sharper corner of the nozzle array 200 are joined together by a joining channel 212. The number of flow paths that are served by the three joined fluid supply channels is 25, which is closer to the number of flow paths (e.g., 32 flow paths) served by each fluid supply channel of a regular length. The joining channel 212 can be of the same width as the fluid supply channels 112, such that flow from the joining channel to each of the joined fluid supply channels is not restricted. The joining channel 212 does not supply fluid directly to any flow path, but can do so via the shorter fluid supply channels 112 that are connected to the joining channel 212.

In addition, in some implementations such as in the printhead module 100 shown in FIG. 1, the fluid supply chamber 104 supplies fluid to the fluid supply channels 112 via supply inlets 118 that are located at respective distal ends of the fluid supply channels 112 that are near the same side of the nozzle array 200 (e.g., near the upper edge of the nozzle array 200 as shown in FIG. 2). However, the shorter fluid supply channels near the acute corner of the nozzle array 200 are not long enough to reach the region below the fluid supply chamber 104. Therefore, in order to supply fluid to the shorter fluid supply channels, the joining channel 212 can extend to the side of the nozzle array 200 that is near the fluid supply chamber 104 (e.g., near the upper edge of the nozzle array 200 as shown in FIG. 2), and has a supply inlet opening at the distal end near the fluid supply chamber 104. Fluid can flow into the supply inlet 118 in the joining channel 212, and travel to each of the three shorter fluid supply channels joined by the joining channel 212, where some of the fluid is circulated through the respective return-side bypass of the three shorter fluid supply channels, and the rest of the fluid is circulated through the flow paths in fluidic communication with the three shorter fluid supply channels. Therefore, the supply inlet 118 in the joining channel 212 functions as the supply inlet for each of the three shorter fluid supply channels connected to the joining channel 212.

Although not shown in FIG. 2, there are shorter channels near the other acute corner of the nozzle array 200 (e.g., the upper right corner of the nozzle array 200 not shown in FIG. 2). Within those shorter channels, some are fluid return channels that are in fluid communication with significantly fewer flow paths in the substrate 108 than the fluid return channels near the main portion of the nozzle array 200. Similar to the shorter fluid supply channels near the lower left corner of the nozzle array 200, the shorter fluid return channels near the upper right corner of the nozzle array 200 can be joined by another joining channel (not shown). Similar to the joining channel 212, the other joining channel can be of the same width as the shorter fluid return channels, and collect un-ejected flow from the shorter fluid return channels. The shorter fluid return channels that are joined by the joining channel (not shown) together collect fluid from a total number of flow paths that is similar to the number of flow paths in fluidic connection with a fluid return channel of regular length. In addition, the joining channel (not shown) also has a return outlet 116 near the lower edge of the nozzle array 200, such that the joining channel can direct fluid collected from the shorter fluid return channels back to the fluid return chamber 106 through the return outlet 116. Although not shown in FIG. 2, the appearance and layout of the channels, supply inlets, supply-side bypass, nozzles, nozzle inlets, and nozzle outlets near the upper right corner of the nozzle array 200 resemble those near the lower left corner of the nozzle array 200 shown in FIG. 2, except that the channels being joined are the shorter fluid return channels, and the joining channel has a return outlet below the fluid return chamber (e.g., near the lower right corner of the nozzle array 200). The return outlet in the joining channel (not shown) can function as the return outlet of the shorter fluid return channels that are near the upper right corner of the nozzle array and connected to the joining channel.

By joining together the shorter fluid supply channels near one acute corner of the nozzle array 200 (and similarly, by joining together the fluid return channels near the other sharper corner of the nozzle array 200), the pressure over each nozzle can be kept more uniformly across the entire nozzle array, leading to better uniformity in drop sizes across the entire printhead module.

In addition, as shown in FIG. 2, the fluid supply channels 112 in the fluid distribution layer are in fluid communication with the fluid supply chamber (now shown) through the supply inlets 118 located at the distal ends of the fluid supply channels that are directly below the fluid supply chamber. The fluid return channels 114 in the fluid distribution layer are in fluid communication with the fluid return chamber (not shown) through the return outlets 116 located at the distal ends of the fluid return channels that are directly below the fluid return chamber. In addition, the fluid supply channels 112 are also in fluid communication with the fluid return chamber through the return-side bypasses 124 located at the distal ends of the fluid supply channels that are directly below the fluid return chamber. Similarly, the fluid return channels are also in fluid communication with the fluid supply chamber through the supply-side bypasses 120 located at the distal ends of the fluid return channels that are directly below the fluid supply chamber.

In some implementations, the shorter fluid supply channels 112 near the acute corner of the nozzle array 200 (e.g., the lower left corner of the nozzle array 200 shown in FIG. 2) are joined by a joining channel 212. The joined shorter fluid supply channels receive fluid from the joining channel 212 which includes a supply inlet 208. Each of the shorter supply channels includes a respective return-side bypass 124. In addition, the joining channel 212 can also connect to one or more shorter fluid return channels 114 near the acute corner of the nozzle array 200 (e.g., the lower left corner of the nozzle array 200) via one or more pinched gaps (e.g., bypass gaps 214), respectively. Each pinched gap is a channel that has a smaller width than the joining channel 212 and the joined fluid return channels 114. Each of the shorter fluid return channels has a return outlet at one distal end in the interface between the fluid return channel and the fluid return chamber, but no supply-side bypass opening at the other distal end in the interface between the fluid return channel and the fluid supply chamber. Instead, the pinched gaps connecting the shorter fluid return channels to the joining channel 212 within the fluid distribution layer 110 can serve as the supply-side bypass for the shorter fluid return channels at the sharper corner of the nozzle array 200. Fluid can pass from the fluid supply chamber through the supply inlet of the joining channel 212, and then pass through the pinched gap to a respective shorter return channel connected to the joining channel 212 via the pinched gap, much like fluid can enter a regular-length fluid return channel directly through a supply-side bypass opening in the top surface of the regular-length fluid return channel.

Similarly, near the other sharper corner of the nozzle array 200, one or more shorter fluid supply channels can be connected to another joining channel (not shown) via one or more pinched gaps, respectively. This other joining channel has a return outlet 116 opening in the interface between the joining channel and the fluid return chamber. Each of the shorter fluid supply channels has a supply inlet opening in the interface between the shorter supply channels and the fluid supply chamber near one distal end of the shorter fluid supply channel, but no return-side bypass opening in the interface between the fluid supply channel and the fluid return chamber at the other distal end. The pinched gap is a narrow channel connecting the joining channel and the shorter fluid supply channels within the fluid distribution layer 110. The pinched gaps can function as the return-side bypasses for the shorter fluid supply channels that are connected to the joining channel via the pinched gaps. For example, fluid can enter the shorter fluid supply channel through the supply inlet opening of the shorter fluid supply channels, and can pass into the joining channel via the pinched gaps much like the fluid can enter a regular-length fluid supply channel and then leak out of the return-side bypass opening in the top surface of the regular-length fluid supply channel. The fluid passing through the pinched gaps can flow back the fluid return chamber through the return outlet of the joining channel (not shown).

Although the above descriptions are made with respect to the configuration shown in FIG. 2, the principles used in aligning the supply channels with lines of nozzle inlets, aligning the return channels with lines of nozzle outlets, joining shorter supply channels using a joining channel to increase the number of nozzle inlets served by the joined supply channels, joining shorter return channels using another joining channel to increase the number of nozzle outlets served by the joined return channels, connecting shorter return channels that do not have regular supply-side bypass openings to a supply-type joining channel (e.g., a joining channel having a supply inlet) via respective pinched gaps in the fluid distribution layer, and connecting shorter supply channels that do not have regular return-side bypass openings to a return-type joining channel (e.g., a joining channel having a return outlet) via respective pinched gaps in the fluid distribution layer, and so on, can be applied in designing the layouts of the supply channels, return channels, and their associated inlets, outlets, and bypasses.

In addition, in some implementations, a first pinched gap can be formed in the fluid distribution layer between a fluid supply channel and an adjacent fluid return channel near the side of the fluid supply chamber, and a second pinched gap can be formed in the fluid distribution layer between the fluid supply channel and the adjacent fluid return channel near the side of the fluid return chamber. The first pinched gap can be used to replace the supply-side bypass opening in the top-surface of the adjacent fluid return channel, and the second pinched gap can be used to replace the return-side bypass opening in the top surface of the fluid supply channel.

In a fluid distribution layer having multiple parallel and alternately positioned fluid supply channels and fluid return channels, each fluid supply channel can have a supply inlet in the interface between the fluid supply channel and the fluid supply chamber, and each fluid return channel can have a return outlet in the interface between the fluid return channel and the fluid return chamber. Each fluid supply channel further includes, within the fluid distribution layer, on the distal end near the fluid return chamber, a respective pinched gap connecting the fluid supply channel to an adjacent fluid return channel on either or both sides of the fluid supply channel. The respective pinched gap can function as the return-side bypass for the fluid supply channel. Similarly, each fluid return channel can further include, within the fluid distribution layer, on the distal end near the fluid supply chamber, a respective pinched gap connecting the fluid return channel to an adjacent fluid supply channel on either or both sides of the fluid return channel. The respective pinched gap can function as the supply-side bypass for the fluid return channel.

FIG. 2 illustrates the relative positions of the components in the fluid distribution layer 110 and the substrate 108, in the lateral dimensions (e.g., when viewed from the side of the fluid manifold 102). FIGS. 3A-3B and FIGS. 4-6 illustrate the two sides of the fluid distribution layer 110, and the different layers in the substrate 108, respectively.

Figure 3A:
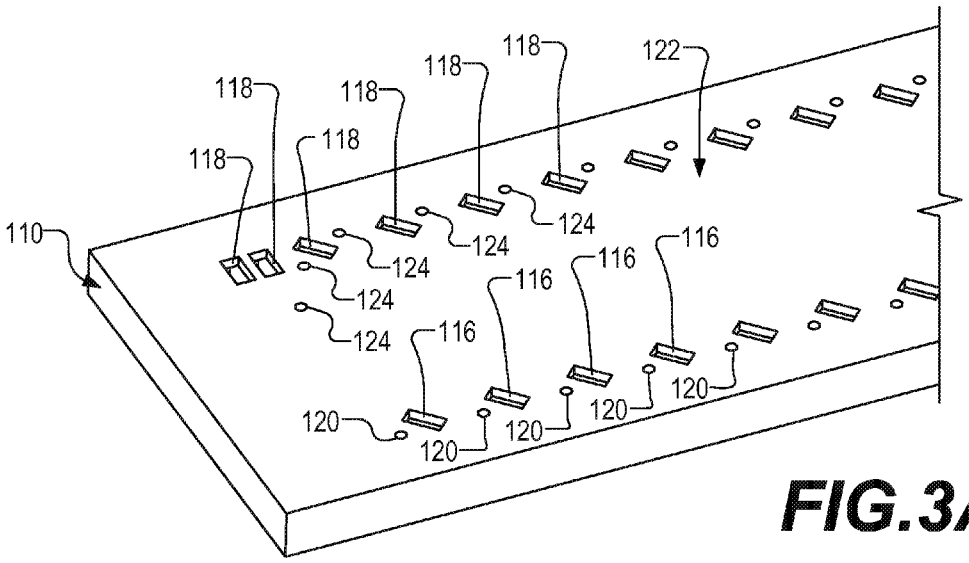
FIG. 3A is a perspective view of the fluid distribution layer viewed from the side of the fluid manifold.

FIG. 3A is a perspective view of the fluid distribution layer 110 viewed from the side of the fluid manifold 102. The fluid distribution layer 110 can be a monolithic body, such as a silicon body having features formed therein. The fluid distribution layer 110 can be a planar layer having a smaller thickness in the vertical dimension relative to the width and length in the lateral dimensions. The top surface 122 of the fluid distribution layer 110 has an array of supply inlets 118. The array of supply inlets 118 can be apertures in the top surface 122 that are open to the fluid supply chamber 104 when the top surface 122 of the fluid distribution layer 110 is bonded to the fluid manifold 102. The top surface 122 of the fluid distribution layer 110 also includes an array of supply-side bypasses 124. The array of supply-side bypasses 124 can be smaller apertures in the top surface 122 that are also open to the fluid supply chamber 104 when the top surface 122 of the fluid distribution layer 110 is bonded to the fluid manifold 102. The supply inlets 118 and the supply-side bypasses 124 can alternate on the side of the top surface 122 that is directly below the fluid supply chamber 104, because the supply inlets and the supply-side bypasses correspond to the fluid supply channels and fluid return channels that alternate in the bottom surface of the fluid distribution layer 110 (as shown in FIG. 3B).

The top surface 122 of the fluid distribution layer 110 also has an array of return outlets 116. The array of return outlets 116 can be apertures in the top surface 122 that are open to the fluid return chamber 106 when the top surface 122 of the fluid distribution layer 110 is bonded to the fluid manifold 102. The top surface 122 of the fluid distribution layer 110 also includes an array of return-side bypasses 120. The array of return-side bypasses 120 can be smaller apertures in the top surface 122 that are also open to the fluid return chamber 104 when the top surface 122 of the fluid distribution layer 110 is bonded to the fluid manifold 102. The return outlets 116 and the return-side bypasses 120 can alternate on the side of the top surface 122 that is directly below the fluid return chamber 106, because the return outlets and the return-side bypasses correspond to the fluid supply channels and fluid return channels that alternate in the bottom surface of the fluid distribution layer (as shown in FIG. 3B).

In some implementations, a joining channel is used to join two or more of the shorter fluid supply channels near one sharper corner of the nozzle array, one of the array of supply inlets in the top surface 122 of the fluid distribution layer belongs to the joining channel. For example, in FIG. 3A, the first supply inlet from the left and on the supply chamber side of the top surface 122 belongs to the joining channel. Similarly, where another joining channel is used to join two or more of the shorter fluid return channels near the other sharper corner of the nozzle array, one of the array of return outlets belongs to this other joining channel. The return outlet of said other joining channel is on the other half of the fluid distribution layer not currently visible in FIG. 3A.

Figure 3B:
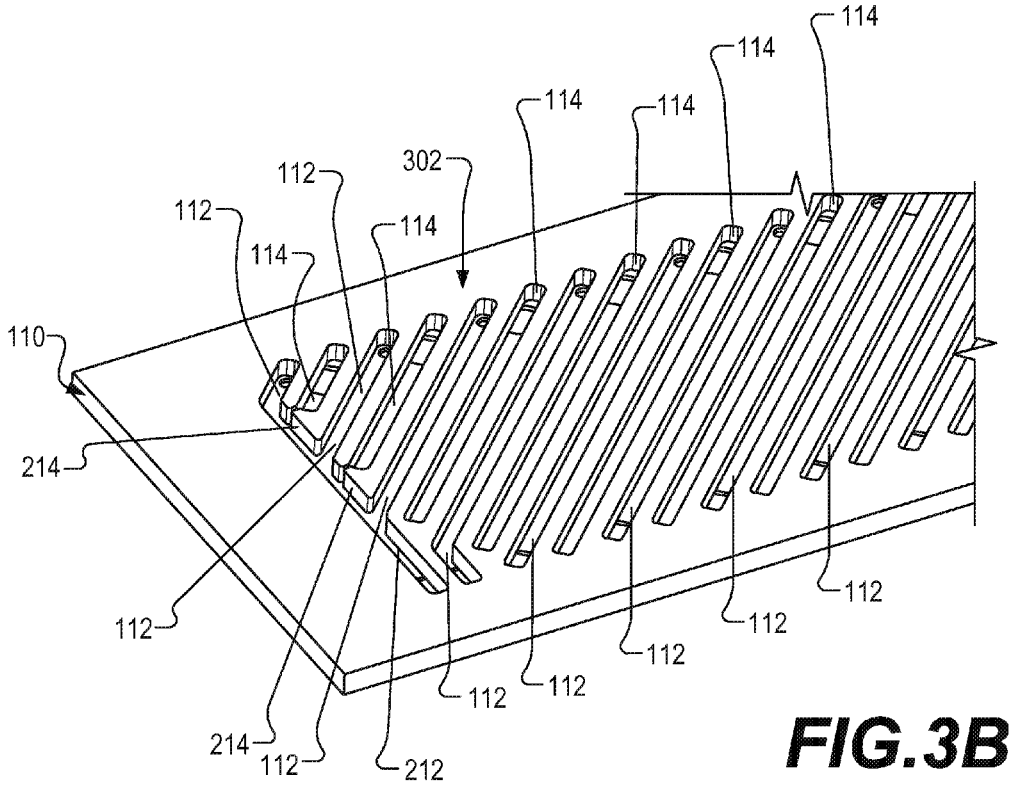
FIG. 3B is a perspective view of the fluid distribution layer viewed from the side of the substrate.

FIG. 3B shows the fluid distribution layer 110 viewed from the bottom side of the fluid distribution layer 110. The bottom surface 302 of the fluid distribution layer 110 has the fluid supply channels 112 and the fluid return channels 114 formed therein. Each fluid supply channel 112 has an open face on the bottom surface 302 of the fluid distribution layer 110, and has a closed face on the top surface 122 of the fluid distribution layer 110, except for a supply inlet opening 118, or a return-side bypass opening 120, or both. Similarly, each fluid return channel 114 has an open face on the bottom surface 302 of the fluid distribution layer 110, and has a closed face on the top surface 122 of the fluid distribution layer 110, except for a return outlet opening 116, or a supply-side bypass opening 124, or both.

FIG. 3B also shows that a joining channel 212 is formed in the bottom surface 302 of the fluid distribution layer 110. The joining channel 212 is connected to two or more (e.g., the first three) shorter fluid supply channels 112 near the sharper corner of the nozzle array (not shown in FIG. 3B) below the fluid distribution layer 110. The joining channel 212 and the connections to the joined shorter fluid supply channels are equal or approximately equal in width and depth to the fluid supply channels, such that minimal flow restriction is imposed by the connections. Although not shown in FIG. 3B, a second joining channel can be formed in the bottom surface 302 of the fluid distribution layer 110. The second joining channel can be used to join two or more shorter fluid return channels at the other end of the fluid distribution layer 110 that is not shown in FIG. 3B.

FIG. 3B also shows that the joining channel 212 can further be connected to one or more shorter fluid return channels 114 via one or more pinched bypass gaps 214, respectively. The one or more pinched bypass gaps 214 can serve to bypass fluid from the joining channel 212 (and hence from the fluid supply chamber 104) to the shorter fluid return channels connected to the joining channel 212. Similarly, the second joining channel (not shown in FIG. 3B) can further be connected to one or more shorter fluid supply channels 112 via one or more pinched bypass gaps (not shown), respectively. The one or more pinched bypass gaps (not shown) can serve to bypass fluid from the shorter fluid supply channels to the second joining channel (not shown) and ultimately to the fluid return chamber 106. The pinched bypass gaps can be narrower in width than the joining channel and the fluid supply/return channels, to create a restriction on the flow between the channels joined by the pinched gaps. In some implementations, the pinched gaps can be shallower in depth in addition, or instead of having a narrower width than the joined channels.

Although FIG. 3B shows that the same joining channel can be used to join shorter fluid supply channels and to connect to shorter fluid return channels via pinched bypass gaps, in some implementations, a separate joining channel that has a supply inlet can be connected to the shorter fluid return channels via pinched gaps. Similarly, although the same joining channel can be used to join shorter fluid return channels and to connect to shorter fluid supply channels via pinched gaps, in some implementations, a separate joining channel that has a return outlet can be connected to the shorter fluid supply channels via pinched gaps.

Figure 4:
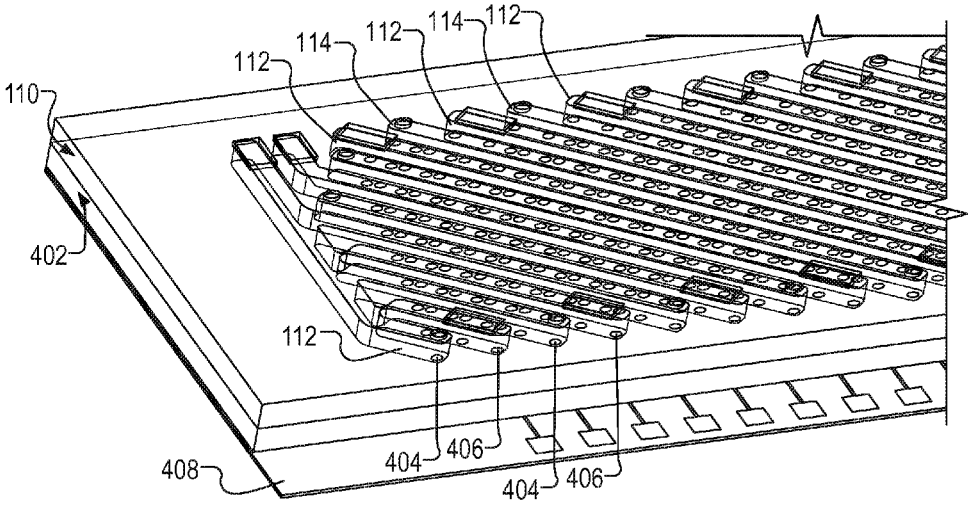
FIG. 4 is a perspective, semi-transparent view of the fluid distribution layer overlaid on the top surface of the substrate.

FIG. 4 is a perspective, semi-transparent view of the fluid distribution layer 110 overlaid on the top surface of the substrate 108. As shown in FIG. 4, the substrate 108 includes a feed layer 402, and the feed layer 402 is bonded to the fluid distribution layer 110 from below. The feed layer can be a planar layer that has a smaller thickness in the vertical dimension than the width and height in the lateral dimensions. The feed layer can be parallel to the other layers in the substrate. The feed layer 402 includes vertically oriented descenders that are in fluidic communication with the nozzle inlets of the flow paths in the substrate 108, and vertically oriented ascenders that are in fluidic communication with the nozzle outlets of the flow paths in the substrate 108. FIG. 4 shows that each fluid supply channel 112 in the fluid distribution layer 110 is over and aligned with a line of openings 404 to the descenders, while each fluid return channel 114 in the fluid distribution layer 110 is over and aligned with a line of openings 406 to the ascenders.

Figure 5:
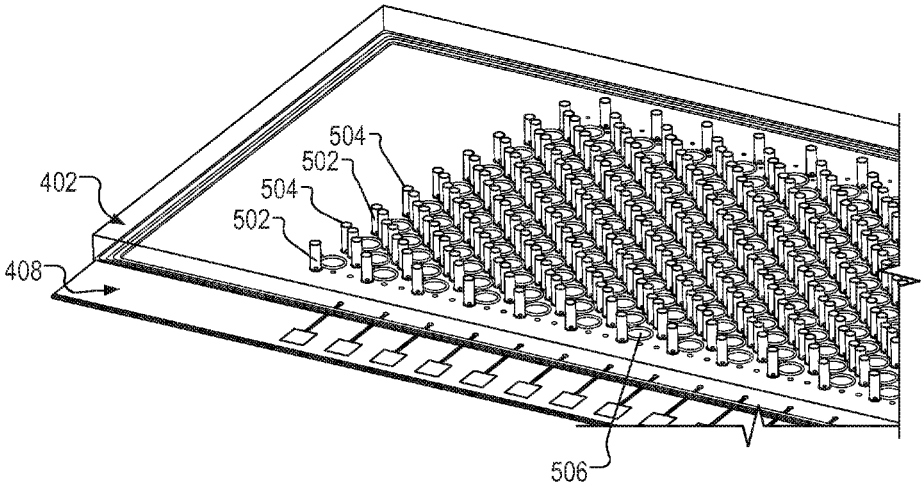
FIG. 5 is a perspective, semi-transparent view of a feed layer in the substrate overlaid on the top surface of an actuation layer in the substrate.

FIG. 4 also shows that an actuation layer 408 can be bonded to the bottom surface of the feed layer 402. FIG. 5 is a perspective, semi-transparent view of the feed layer 402 overlaid on the top surface of the actuation layer 408 in the substrate 108.

As shown in FIG. 5 the feed layer 402 includes lines of descenders 502 and lines of ascenders 504. Each line of descenders 502 can funnel fluid from a respective fluid supply channel in the fluid distribution layer 110 above the feed layer 402, to a corresponding line of nozzle inlets in the actuation layer 408 below the feed layer 402. Each line of ascenders 502 can funnel fluid from a line of nozzle outlets in the actuation layer 408 below the feed layer 402, up to a fluid return channel in the fluid distribution layer 110 above the feed layer 402.

Also shown in FIG. 5 is the actuation layer 408 below the feed layer 402. The actuation layer 408 can include a membrane layer attached to the top side of the pumping chamber layer (not shown in FIG. 5). The actuation layer 408 can further includes a plurality of piezoelectric actuator structures disposed on the membrane layer, with each actuator structure positioned over an associated pumping chamber cavity (not shown in FIG. 5). The piezoelectric actuator structures can be supported on the top side of the membrane layer. If the membrane layer does not exist in a particular embodiment, the actuation structure can be disposed directly on the top side of the pumping chamber layer, and the bottom surface of the piezoelectric structure can seal the pumping chamber cavities from above.

The membrane layer can be an oxide layer that seals the pumping chamber from above. The portion of the membrane layer over a pumping chamber cavity is flexible and capable of flexing under the actuation of a piezoelectric actuator. The flexing of the membrane expands and contracts the pumping chamber cavity and cause ejection of fluid droplets out of a nozzle connected to the pumping chamber cavity. As shown in FIG. 5, the actuation layer 408 includes individually controlled actuators 506 that are disposed over the pumping chamber cavities in the pumping chamber layer (not shown in FIG. 5) below the actuation layer 408. In some implementations, the feed layer 402 can be an ASIC wafer that includes electronics and circuits for controlling the operation of the actuators.

Figure 6:
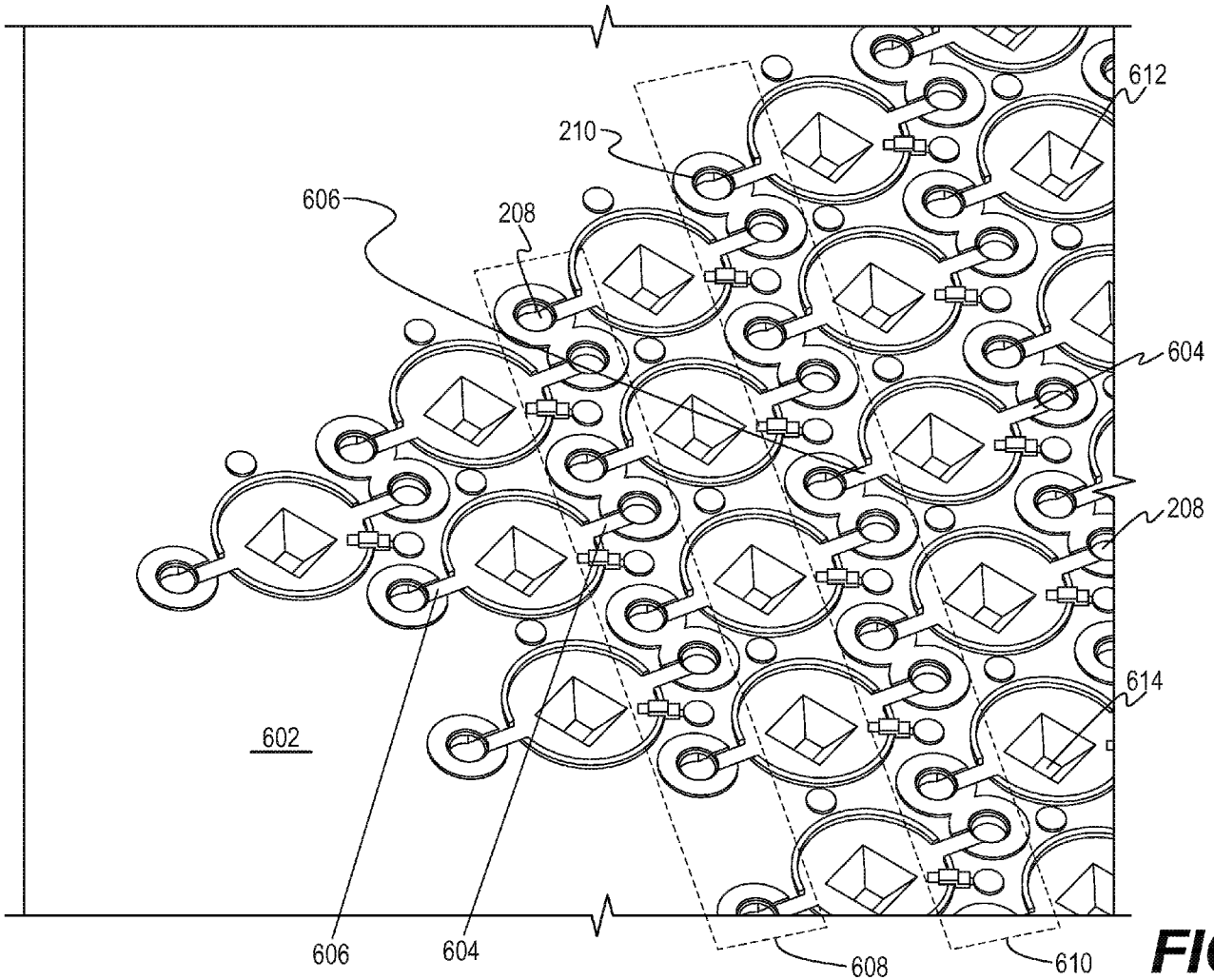
FIG. 6 is a perspective view of a pumping chamber layer and a nozzle layer in the substrate.

FIG. 6 is a perspective view of the pumping chamber layer 602 and a nozzle layer below the pumping chamber layer 602. As shown in FIG. 6, the pumping chamber layer 602 includes a plurality of pumping chamber cavities 612. Each pumping chamber cavity 612 is situated over a corresponding nozzle 614 in the nozzle layer. Each pumping chamber cavity 612 is further connected to a respective inlet feed 604 that leads to a respective neighboring nozzle inlet 208, and a respective outlet feed 606 that leads to a respective neighboring nozzle outlet 210. Also, as shown in FIG. 6, each line of nozzle inlets (e.g., the line 608) in the pumping chamber layer 602 serve the pumping chambers that are situated on both sides of the line of nozzle inlets. Similarly, each line of nozzle outlets (e.g., the line 610) in the pumping chamber layer 602 serve the pumping chambers that are situated on both sides of the line of nozzle outlets.

Figure 7A:
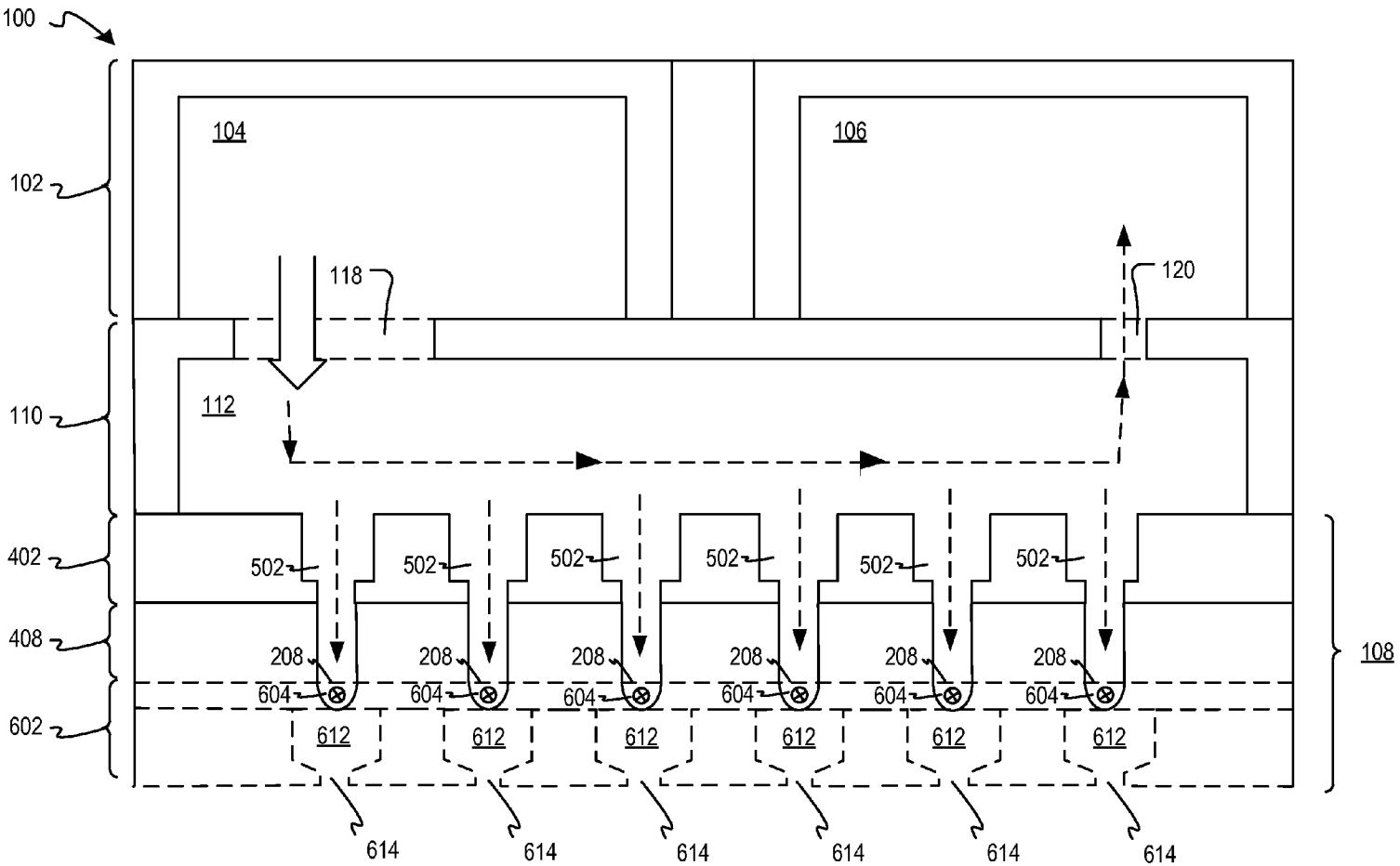
FIG. 7A illustrates fluid flow through an example printhead module viewed from a first cross-section of the example printhead module.

FIG. 7A illustrates fluid flow through an example printhead module (e.g., the printhead module 100) viewed from a first cross-section of the example printhead module. The first cross-section cuts across a single fluid supply channel in a plane parallel to the direction of fluid flow in the fluid supply channel and perpendicular to the plane of the planar fluid distribution layer. As shown in FIG. 7A, fluid flows along the length of the fluid supply channel 112 from the distal end proximate the fluid supply chamber 104 to the other distal end proximate the fluid return chamber 106. This flow can occur because a pressure difference has been created between the fluid supply chamber 104 and the fluid return chamber 106, for example, by a pump.

As shown in FIG. 7A, the fluid supply channel 112 receives fluid from the supply inlet 118 that is in the top surface of the fluid supply channel 112 and that opens to the fluid supply chamber 104. The fluid travels along the fluid supply channel 112 to the return-side bypass 120, and enters the fluid return chamber 106 through the return-side bypass that is in the top surface of the fluid supply channel 112 and that is fluidically connected (e.g., opens) to the fluid return chamber 106.

The size of the return-side bypass 120 is smaller than the size of the supply inlet 118, such that a flow resistance of the return-side bypass 120 is at least 10 times that of the flow resistance of the supply inlet 118. Such a flow resistance difference can ensure that the fluid pressure along the entire length of the fluid return channel is roughly constant. In an example implementation, the size of the return-side bypass 120 can be approximately 1/50 of the size of the supply inlet 118. The diameter of the return-side bypass 120 can have a radius of 25-150 microns (e.g., 50 microns) and 75-300 microns deep (e.g., 75 microns).

As shown in FIG. 7A, some of the fluid that enters the fluid supply channel 112 does not return to the fluid return chamber 106 from the return-side bypass 120 directly. Instead, fluid can flow into a number of pumping chamber cavities 612 in the substrate 108 through a number of descenders 502 connected to the fluid supply channel 112. The descenders 502 are vertically oriented channels each being fluidically connected (e.g., open) to the fluid supply channel 112 at one end, and fluidically connected (e.g., open) to a nozzle inlet 208 at the other end. Each of the nozzle inlet 208 is fluidically connected (e.g., joined) to an inlet feed 604 that leads to a respective pumping chamber cavity 612. The fluid that enters the pumping chamber cavity 612 from the descender 502 can be ejected out of the nozzle 614 in response to an actuation of the pumping chamber membrane or pass the nozzle 614 without being ejected. The un-ejected fluid can be directed to one or more recirculation paths (shown in FIG. 7C) in the substrate 108.

Figure 7B:
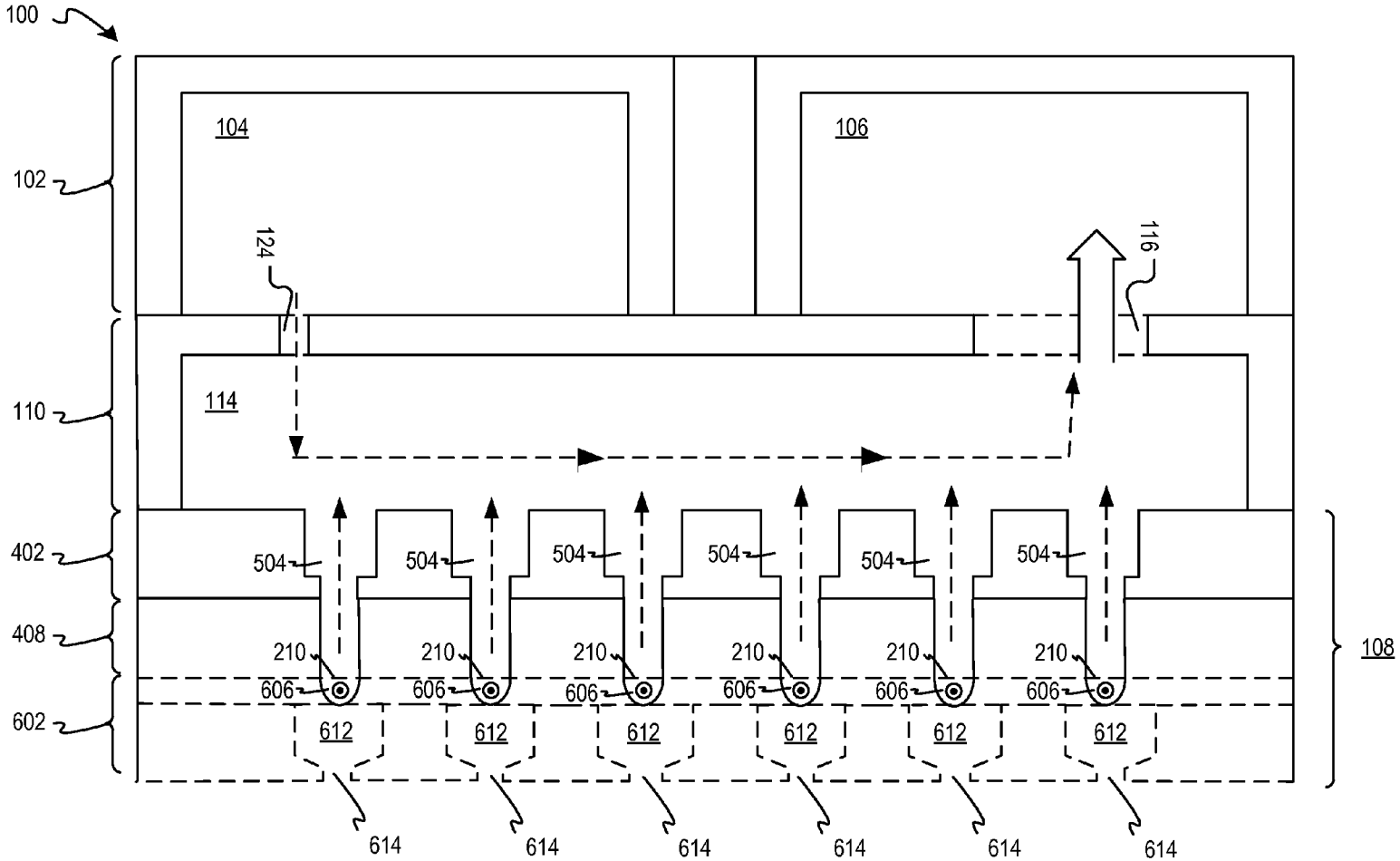
FIG. 7B illustrates fluid flow through the example printhead module viewed from a second cross-section of the example printhead module.

FIG. 7B illustrates fluid flow through an example printhead module (e.g., the printhead module 100) viewed from a second cross-section of the example printhead module. The second cross-section cuts across a single fluid return channel in a plane parallel to the direction of fluid flow in the fluid return channel and in a plane perpendicular to the planar fluid distribution layer. As shown in FIG. 7A, fluid flows along the length of the fluid return channel 114 from the distal end proximate the fluid supply chamber 104 to the other distal end proximate the fluid return chamber 106. This flow occurs because a pressure difference has been created between the fluid supply chamber 104 and the fluid return chamber 106, for example, by a pump.

As shown in FIG. 7B, the fluid return channel 114 receives fluid from the supply-side bypass 124 that is in the top surface of the fluid return channel 114 and that is fluidically connected (e.g., opens) to the fluid supply chamber 104. The fluid travels along the fluid return channel 114 to the return outlet 116, and enters the fluid return chamber 106 through the return outlet 116 that is in the top surface of the fluid return chamber 116 and that is fluidically connected (e.g., opens) to the fluid return chamber 106.

The size of the supply-side bypass 124 is smaller than the size of the return outlet 116 (e.g., 1/50 of the size of the return outlet 116), therefore, flow rate is restricted at the supply-side bypass 124. As shown in FIG. 7B, some additional fluid is drawn into the fluid supply channel 114 through a number of ascenders 504. The ascenders 504 are vertically oriented channels each being open to the fluid return channel 114 at one end, and open to a nozzle outlet 210 at the other end. The nozzle outlet 210 is fluidically connected (e.g., joined) to an outlet feed 606 that leads from a pumping chamber cavity 612 to the nozzle outlet 210. The fluid then is drawn up the ascenders 504 and into the fluid return channel 114. The fluid from the supply-side bypass 124 as well as the un-ejected fluid drawn from the pumping chamber cavities 612 can pass through return outlet 116 in the top surface of the fluid return channel 114 into the fluid return chamber 106.

Figure 7C:
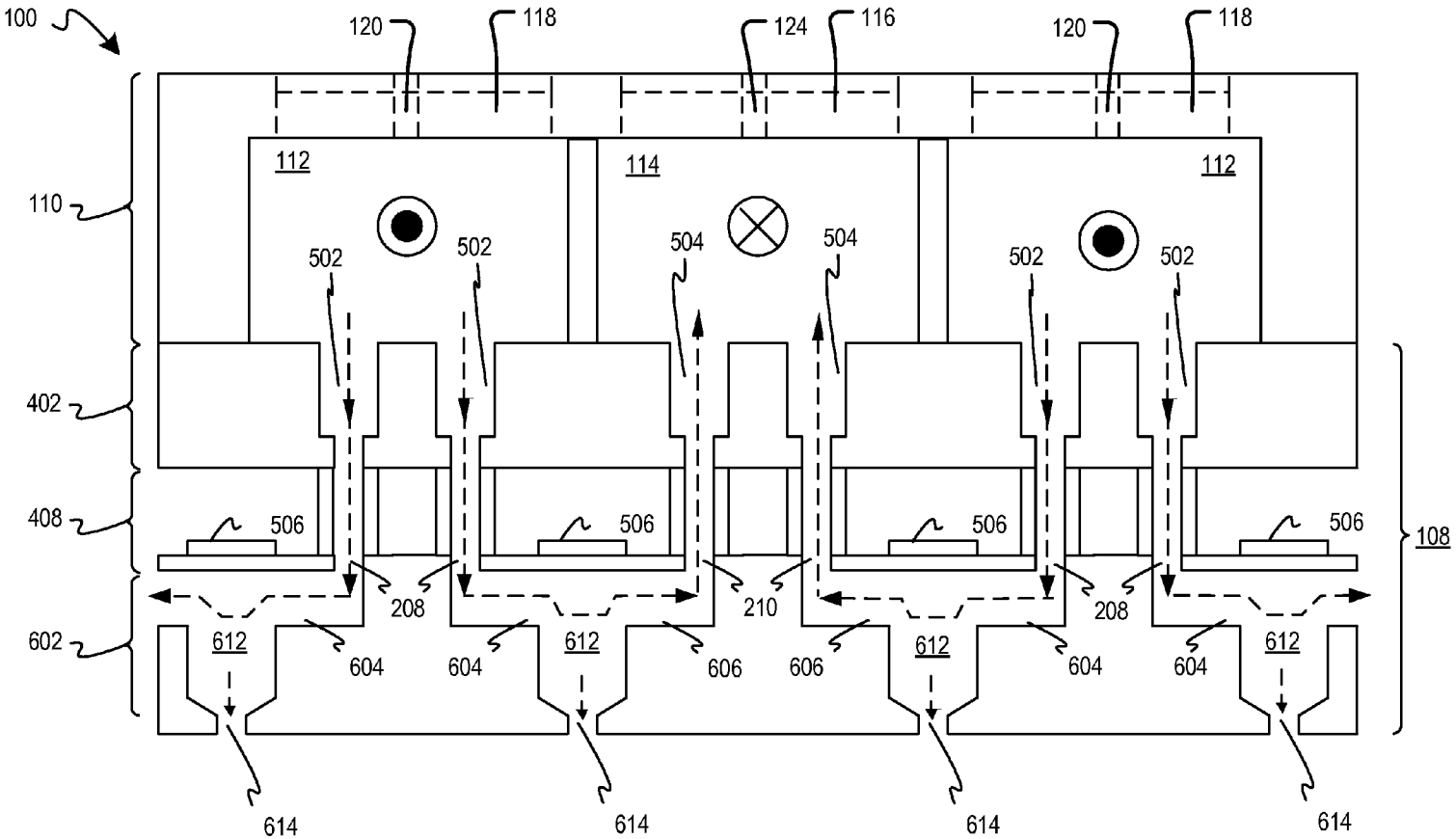
FIG. 7C illustrates fluid flow through the example printhead module viewed from a third cross-section of the example printhead module.

FIG. 7C illustrates fluid flow through an example printhead module (e.g., the printhead module 100) viewed from a third cross-section of the example printhead module. The third cross-section cuts across multiple consecutive fluid supply and return channels in a plane perpendicular to the direction of fluid flow in the fluid supply and return channels.

For illustration purposes, only three fluid channels are shown in FIG. 7C. As shown in FIG. 7C, in the fluid distribution layer 110, fluid flows along the fluid supply channels 112 in a first direction (e.g., out of the page), while fluid flows along the fluid return channels 114 in a second, opposite direction (e.g., into the page).

Within the substrate 108, a flow path is formed between a particular fluid supply channel 112 and a fluid return channel 114 that is adjacent to the particular fluid supply channel 112. If the particular fluid supply channel has an adjacent fluid supply channel on both sides, at least one flow path can be formed between the fluid supply channel and each of the two adjacent fluid supply channels.

For example, as shown in FIG. 7C, fluid can flow from the first fluid supply channel on the left into a descender 502 fluidically connected to the first fluid supply channel, through the descender 502 into a nozzle inlet 208 in the pumping chamber layer 602, through the nozzle inlet 208 into an inlet feed 604, and through the inlet feed 604 into a pumping chamber cavity 612, through the pumping chamber cavity 612 into an outlet feed 606, through the outlet feed 606 into a nozzle outlet 210, through the nozzle outlet 210 into an ascender 504, through the ascender 504, and ending in the fluid return channel 114 that is adjacent to the first fluid supply channel in FIG. 7C. A similar flow can be formed between the first fluid supply channel in FIG. 7C and the other fluid return channel that is adjacent to the first fluid supply channel but not shown in FIG. 7C.

For another example, as shown in FIG. 7C, fluid can flow from the second fluid supply channel on the right side of FIG. 7C and the fluid return channel 114 that is adjacent to the second fluid supply channel in FIG. 7C (i.e., the fluid return channel shown in the middle of FIG. 7C). A similar flow can be formed between the second fluid supply channel in FIG. 7C and the other fluid return channel that is adjacent to the second fluid supply channel but not shown in FIG. 7C.

The fluid flow between each fluid supply chamber and an adjacent fluid return chamber can be maintained due to a pressure difference between the fluid supply channel and the fluid return channel created by the return-side bypass. The return-side bypass can restrict the flow rate through the return-side bypass to a small fraction of the flow rate through the supply inlet, such as 1/50 of the flow rate through the supply inlet. In some implementations, the pressure difference created between the supply inlet and the return-side bypass can be in a range of 10 to 1000 millimeter of water pressure.

In some implementations, the fluid flow through the supply inlet can be kept at at least twice the peak jetting flow (e.g., the flow rate out of the nozzles when all nozzles are ejecting fluid droplets). The fluid that is not ejected out of the nozzles can be re-circulated through the recirculation paths shown in FIG. 7C, for example. Keeping at least 50% of the fluid flow into the substrate re-circulated can ensure that there is sufficient amount of fluid flow to carry contaminants from their original sites in the flow path, and to push the re-circulated fluid through the filter(s) without using additional pumping devices.

When designing the dimensions of the supply inlets, the return outlets, the bypass openings and gaps, a number of factors are considered. First the dimensions of the supply inlets can be determined based on the amount of desired flow rate (e.g., at least twice the peak jetting flow rate, or less). The desired flow rate may be different for different fluid ejection systems. In some implementations, each supply inlet can have a dimension of approximately 130 microns by 300 microns. The dimensions of the bypass openings and gaps can be determined based on the amount of pressure difference that is required to generate the flow in the flow paths. In addition, the relative sizes of the supply inlet and the return-side bypasses or gaps can depend on the desired temperature regulation range near the nozzles. In some implementations, the apertures for the bypass openings can have a radial dimension of 40-100 microns (e.g., in case of a circular bypass opening). In some implementations, the fluid supply channels can have a width of 130-200 microns, and a depth of about 200-500 microns (e.g., 325 microns). In some implementations, the dimensions of the bypass gaps can be 200-1000 microns long (e.g., 420 microns long), 20-100 microns wide (e.g., 30 microns wide), and 200-500 microns deep (e.g., 325 microns deep). In some implementations, the dimensions of the fluid return channels can mirror those of the fluid supply channels, and the dimensions of the supply-side bypass openings and gaps can mirror those of the return-side bypass openings and gaps.

When designing the sizes of the bypass openings, the desired temperature control range and the efficiency of the heat exchange between the fluid and the substrate can be considered. The efficiency of heat exchange can depend on the thermal conductivity of the fluid, a density of the fluid, a specific heat of the fluid, the dimensions of the flow passages, and so on. The sizes of the bypass openings and the supply inlet, and return outlet can be tuned to achieve a heat exchange efficiency that is sufficient to maintain the nozzles and other parts of the substrate at the desired temperature or within the desired temperature range.

The sizes of the supply inlets, the return outlets, the supply-side bypasses, the return-side bypass, and the supply and return channels can also depend on the number of nozzles each channel serves, and the size of the droplets being ejected, the overall printhead size, the overall number of nozzles, and so on. For example, a relatively great number of nozzles may require a relatively greater thermal exchange efficiency to maintain the nozzles at a predetermined temperature or within a predetermined temperature range. The dimensions of the recirculation paths and the flow rate therein can be configured to achieve a degree of thermal conductivity sufficient to maintain the nozzles at the desired temperature or within the desired range of temperatures.

A flow rate of fluid through the printhead is typically much higher than a flow rate of fluid through the substrate. That is, of the fluid flowing into the printhead module, most of the fluid can circulate through the supply and return passages. For example, a flow rate of fluid into the printhead 100 can be more than two times greater than a flow rate of fluid into the substrate. In some implementations, the flow rate of fluid into the printhead can be between 30 times and about 70 times greater than the flow rate of fluid into the substrate. These ratios can vary depending on whether or not the flow rates are considered during fluid droplet ejection, and if so, depending on the frequency of fluid drop ejection. For example, during fluid droplet ejection, the flow rate of fluid into the substrate can be higher relative to the flow rate of fluid into the substrate when no fluid droplet ejection is occurring. As a result, the ratio of flow rate of fluid into the printhead to the flow rate of fluid into the substrate can be lower during fluid droplet ejection relative to when no fluid droplet ejection is occurring.

In some implementations, circulating fluid through the substrate can prevent drying of fluid in the substrate, such as near the nozzles, and can remove contaminants from the substrate fluid path. Contaminants can include air bubbles, aerated fluid (i.e., fluid containing dissolved air), debris, dried fluid, and other objects that may interfere with fluid droplet ejection. If the fluid is ink, contaminants can also include dried pigments or agglomerations of pigment. Removing air bubbles is desirable because air bubbles can absorb or detract from energy imparted by the transducers and fluid pumping chambers, which can prevent fluid droplet ejection or cause improper fluid droplet ejection. The effects of improper droplet ejection can include varying the size, speed, and/or direction of an ejected fluid droplet. Removal of aerated fluid is also desirable because aerated fluid is more likely to form bubbles than deaerated fluid. Other contaminants, such as debris and dried fluid, can similarly interfere with proper fluid droplet ejection, such as by blocking a nozzle.

Optionally, a degasser or filter can be inserted at one or more locations within the circulation paths in the printhead module, and configured to deaerate fluid and/or to remove air bubbles from the fluid. The degasser can be fluidly connected between the return chamber and the fluid return chamber, such as between the fluid return chamber and a fluid return tank, between the fluid return tank and a fluid supply tank, between the fluid supply tank and the fluid supply chamber, within one or both of the fluid supply chamber and the fluid return chamber, or some other suitable locations.

The use of terminology such as "front," "back," "top," "bottom," "over," "above," and "below" throughout the specification and claims is for describing the relative positions of various components of the system, printhead, and other elements described herein. Similarly, the use of any horizontal or vertical terms to describe elements is for describing relative orientations of the various components of the system, printhead, and other elements described herein. Unless otherwise stated explicitly, the use of such terminology does not imply a particular position or orientation of the printhead or any other components relative to the direction of the Earth gravitational force, or the Earth ground surface, or other particular position or orientation that the system, printhead, and other elements may be placed in during operation, manufacturing, and transportation.

A number of embodiments of the invention have been described. Nevertheless, it will be understood that various modifications may be made without departing from the spirit and scope of the inventions. For example, multiple circulation paths can be arranged between the fluid supply chamber and the fluid return chamber. In other implementations, the fluid return chamber can be omitted and the fluid flowing out of the substrate can be disgarded, and the fluid supply chamber and the fluid reservoir can be configured accordingly. In other implementations, passages and flow rates can be configured from momentarily reversing flow of fluid through all or a portion of the substrate fluid path during fluid droplet ejection.

What is claimed is:

1. A method for circulating fluid in a fluid ejection device, comprising:

flowing a first flow of fluid in sequence of: flowing the fluid from a fluid supply chamber to a supply inlet connecting the fluid supply chamber and a fluid supply channel of a plurality of supply channels running in parallel to each other, through the supply inlet and into the fluid supply channel, across the fluid supply channel to a bypass fluidically connecting the fluid supply channel to a fluid return channel of a plurality of return channels running in parallel to each other, and through the bypass into the fluid return channel, and across the fluid return channel to a fluid return chamber; and simultaneously with flowing the first flow of fluid, flowing a second flow of fluid across the fluid supply channel to a pumping chamber cavity, through the pumping chamber cavity and into the fluid return channel, across the fluid return channel to the fluid return chamber, wherein the first flow of fluid and the second flow of fluid are in fluidic communication within the fluid supply channel, and wherein the pumping chamber cavity is in fluidic communication with a nozzle defined in a nozzle surface, and the plurality of supply channels each runs in parallel with the nozzle surface.

2. The method of claim 1, further comprising creating a pressure difference between the fluid supply chamber and the fluid return chamber, which causes the first flow and the second flow.

3. The method of claim 1, further comprising maintaining the second flow without ejecting fluid droplets from the nozzle.

4. An apparatus for ejecting fluid droplets, comprising:

a fluid manifold comprising a fluid supply chamber and a fluid return chamber;

a first path, in a printhead module, including a supply inlet connecting the fluid supply chamber to a fluid supply channel of a plurality of supply channels running in parallel to each other, and a bypass fluidically connecting the fluid supply channel directly to a fluid return channel of a plurality of return channels running in parallel to each other, and a return outlet connecting the fluid return channel to the fluid return chamber; and a second path, in the printhead module, including the supply inlet connecting the fluid supply chamber to the fluid supply channel, the fluid supply channel connected to a pumping chamber cavity, the pumping chamber cavity connected to the fluid return channel, wherein the first path and the second path are in fluidic communication within the fluid supply channel within the printhead module, and wherein the pumping chamber cavity is in fluidic communication with a nozzle defined in a nozzle surface, and the plurality of supply channels each runs in parallel with the nozzle surface.

5. The apparatus of claim 4, wherein the bypass is a gap having a width smaller than a width of the return channel and the supply channel.

6. The apparatus of claim 5, wherein the supply inlet of the fluid supply channel is positioned at a first distal end of the fluid supply channel, and the gap is located at a second distal end of the supply channel opposite to the first distal end.

7. The apparatus of claim 5, wherein a flow resistance of the gap is more than ten times a flow resistance of the supply inlet.

8. The apparatus of claim 4, wherein the bypass is in a top surface of the fluid supply channel.

9. The apparatus of claim 4, further comprising a plurality of first paths and a plurality of second paths, wherein the second paths include a plurality of pumping chamber cavities that includes the pumping chamber cavity and that are fluidically connected to a plurality of nozzles including the nozzle through which fluid droplets are ejected.

10. The apparatus of claim 9, wherein the plurality of nozzles is distributed in a parallelogram-shaped nozzle array in a nozzle layer having the nozzle surface.

11. The apparatus of claim 10, wherein:

the plurality of nozzles is arranged in a plurality of parallel nozzle columns in the nozzle layer;

the plurality of fluid supply channels and the plurality of fluid return channels are parallel to each other and parallel to the nozzle layer;

the plurality of parallel nozzle columns are along a first direction, the first direction being at a first angle relative to a media scan direction associated with the apparatus; and the plurality of fluid supply channels and the plurality of fluid return channels are along a second direction, the second direction being at a second, different angle relative to the media scan direction.

12. The apparatus of claim 9, wherein each pumping chamber cavity is fluidically connected to a location along a respective fluid supply channel and between respective locations of a respective supply inlet and a respective bypass of the respective fluid supply channel.

13. The apparatus of claim 9, wherein each pumping chamber cavity is fluidically connected to a location along a respective fluid return channel and between respective locations of a respective return outlet and a respective bypass of the respective fluid return channel.

14. The apparatus of claim 9, wherein the fluid supply channels and fluid return channels are parallel and alternately arranged to each other, and each pair of adjacent fluid supply channel and fluid return channel are fluidically connected to each other through at least one pumping chamber cavity.

15. The apparatus of claim 4, wherein the plurality of supply channels, the plurality of return channels, the bypass, and the supply inlet are formed in a substantially planar layer having a thickness perpendicular to the nozzle surface that is less than a width parallel to nozzle surface.

16. The apparatus of claim 4, wherein the supply channel is located after the fluid supply chamber such that a fluid flows from the fluid supply chamber to the supply channel.

17. The apparatus of claim 4, wherein the supply channel comprises a side wall and an inlet through which fluid is supplied from the fluid supply channel to the pumping chamber is in the side wall.

18. An apparatus for ejecting fluid droplets, comprising:

a fluid manifold comprising a fluid supply chamber and a fluid return chamber;

a plurality of flow paths, in a printhead module, configured to eject fluid droplets, each flow path including a nozzle inlet, a pumping chamber cavity, a nozzle, and a nozzle outlet, the nozzle of each flow path being defined in a nozzle surface;

a supply channel of a plurality of supply channels running in parallel to each other and parallel to the nozzle surface, in the printhead module, fluidically connecting the fluid supply chamber to the plurality of flow paths through the nozzle inlets of the flow paths;

a return channel of a plurality of return channels running in parallel to each other, in the printhead module, fluidically connecting the plurality of flow paths to the fluid return chamber through the nozzle outlets of the flow paths; and a bypass, in the printhead module, fluidically connecting the supply channel directly to the return channel, the bypass being configured to pass a portion of a fluid that has entered the supply channel into the return channel.

19. The apparatus of claim 18, further comprising a plurality of bypasses including the bypass.

20. The apparatus of claim 19, wherein the plurality of supply channels and the plurality of return channels are parallel and alternately arranged to each other, and each pair of adjacent supply channel and return channel are fluidically connected to each other through at least one pumping chamber cavity.

21. The apparatus of claim 18, wherein the bypass is in a top surface of the supply channel.

* * * * *